US012358681B2

(12) United States Patent
Corbett et al.

(10) Patent No.: US 12,358,681 B2
(45) Date of Patent: Jul. 15, 2025

(54) INTER-CONNECTING MEANS FOR MULTI-PART CONTAINER

(71) Applicant: Eco.Logic Brands Inc., Manteca, CA (US)

(72) Inventors: Julie Corbett, Oakland, CA (US); Greg Rodrigues, San Francisco, CA (US); Phil Streets, Ottawa (CA); Romeo Graham, Ottawa (CA); Robert Watters, Ottawa (CA); Luc Boucher, Ottawa (CA)

(73) Assignee: ECO.LOGIC BRANDS INC., Manteca, CA (US)

( * ) Notice: Subject to any disclaimer, the term of this patent is extended or adjusted under 35 U.S.C. 154(b) by 0 days.

(21) Appl. No.: 16/160,964

(22) Filed: Oct. 15, 2018

(65) Prior Publication Data

US 2019/0135479 A1 May 9, 2019

Related U.S. Application Data

(63) Continuation of application No. PCT/US2017/027745, filed on Apr. 14, 2017.
(Continued)

(51) Int. Cl.
*B65D 3/28* (2006.01)
*B65D 3/04* (2006.01)
(Continued)

(52) U.S. Cl.
CPC ..... *B65D 3/28* (2013.01); *B65D 3/04* (2013.01); *B65D 3/10* (2013.01); *B65D 3/26* (2013.01); *B65D 13/04* (2013.01); *B65D 65/466* (2013.01)

(58) Field of Classification Search
CPC ... B65D 3/28; B65D 3/04; B65D 3/10; B65D 3/26; B65D 13/04; B65D 65/466
(Continued)

(56) References Cited

U.S. PATENT DOCUMENTS 3,154,827 A 11/1964 Gentry
3,249,284 A 5/1966 Wood
(Continued)

FOREIGN PATENT DOCUMENTS

DE 202009016772 U1 5/2010
JP 2008050049 A 3/2008
(Continued)

OTHER PUBLICATIONS

EP17783301.9 The Extended European Search Report dated Sep. 6, 2019.
(Continued)

*Primary Examiner* — Anthony D Stashick
*Assistant Examiner* — L Kmet
(74) *Attorney, Agent, or Firm* — CANTOR COLBURN LLP

(57) ABSTRACT

An inter-connecting structure is provided for connecting multiple parts of a container. The inter-connecting structure comprises a first part comprising a plurality of inter-connecting tabs and slits on an edge; a second part comprising a plurality of inter-connecting tabs and slits on an edge to be joined with the edge of the first part; wherein the inter-connecting tabs and slits share an overlapping portion and once the two parts are connected to each other, the engaged inter-connecting tabs are disposed in an internal region of the container.

20 Claims, 24 Drawing Sheets

Part A

Part B

Related U.S. Application Data

(60) Provisional application No. 62/323,388, filed on Apr. 15, 2016.

(51) Int. Cl.

| | |
|---|---|
| ***B65D 3/10*** | (2006.01) |
| ***B65D 3/26*** | (2006.01) |
| ***B65D 6/00*** | (2006.01) |
| ***B65D 65/46*** | (2006.01) |

(58) Field of Classification Search
USPC ..... 215/382
See application file for complete search history.

(56) References Cited

U.S. PATENT DOCUMENTS

| | | | | |
|---|---|---|---|---|
| 3,306,520 | A * | 2/1967 | Allard | B65D 5/6652 229/149 |
| 3,341,908 | A | 9/1967 | Lock | |
| 3,446,417 | A | 5/1969 | Eisenberg et al. | |
| 4,433,807 | A | 2/1984 | Ganz | |
| 4,846,394 | A * | 7/1989 | Swanson | B65D 3/04 229/4.5 |
| 5,056,679 | A | 10/1991 | Lonczak | |
| 5,065,891 | A * | 11/1991 | Casey | B65F 1/06 220/495.08 |
| 5,372,269 | A | 12/1994 | Sutton et al. | |
| 5,415,613 | A | 5/1995 | McGrath | |
| 5,940,935 | A | 8/1999 | Julius | |
| 6,299,010 | B1 * | 10/2001 | Hsu | B65F 1/02 220/4.08 |
| 6,315,123 | B1 * | 11/2001 | Ikeda | B65D 71/12 229/198.2 |
| 8,430,262 | B2 * | 4/2013 | Corbett | B65D 25/16 229/406 |
| 8,887,941 | B2 | 11/2014 | Heintzman | |
| 2002/0084273 | A1 | 7/2002 | Ming | |
| 2007/0194020 | A1 | 8/2007 | Hotze | |
| 2007/0194022 | A1 | 8/2007 | Huggett | |
| 2008/0289232 | A1 | 11/2008 | Richards | |
| 2012/0145710 | A1 | 6/2012 | Corbett et al. | |
| 2013/0283739 | A1 * | 10/2013 | Tasner | B65D 65/38 53/467 |
| 2015/0314916 | A1 | 11/2015 | Corbett et al. | |
| 2020/0071025 | A1 | 3/2020 | Corbett et al. | |

FOREIGN PATENT DOCUMENTS

| | | | |
|---|---|---|---|
| JP | 2011070969 | A | 4/2011 |
| JP | 2011234711 | A | 11/2011 |
| JP | 2012501930 | A | 1/2012 |
| JP | 2014101150 | A | 6/2014 |
| WO | 02090209 | A1 | 11/2002 |
| WO | 2017181095 | A1 | 10/2017 |
| WO | WO-2018165276 | | 9/2018 |

OTHER PUBLICATIONS

PCT/US2017/027745 International Search Report and Written Opinion dated Jul. 10, 2017.

PCT/US2018/021314 International Search Report dated May 10, 2018.

Japanese Office Action; Japanese Application No. 2018-554403; Date of Mailing: Sep. 7, 2021; 6 pages.

Japanese Office Action for Japanese Application No. 2023-121577; Report Mail Date Sep. 26, 2024 (4 Pages—with English Translation).

* cited by examiner

Part B

Part A

INTER-CONNECTING MEANS FOR MULTI-PART CONTAINER

CROSS-REFERENCE

This application is a Continuation Application of International Patent Application PCT/US2017/027745, filed Apr. 14, 2017, which claims priority to Provisional Patent Application No. 62/323,388, filed on Apr. 15, 2016, each of which is entirely incorporated herein by reference.

BACKGROUND OF THE INVENTION

Paper bottles such as molded fiber, fiber or pulp bottles are degradable and widely recyclable that benefit the environment. However, the manufacture of current paper bottles the containers are made of a plurality of parts that need to be joined together with glue and this is complex and costly and involves significant use of adhesives (e.g., glue) and time. The use of adhesive during the assembly process poses a number of challenges. It can be slow, especially as the adhesive needs to be applied to a detailed path which is the case for a pulp bottle, resulting low manufacturing output and high cost. Additionally, adhesives properties are easily affected by factors that can be difficult to control including: humidity, temperature, compression, and settling time. These factors can significantly effect the strength of the container. Some types of glues may require a catalyst such as UV light. At times, glue can force the release of a layer of the pulp surface, thereby ceasing to perform. The majority of the pulp is still intact but unable to mechanically perform due to the adhesive release.

It is known that cardboard has techniques using slots and tabs for closure or connection. However, in most cases, these assembly features are disposed to an outer portion of a container that affects the smoothness of the surface. Also, these assembly features are typically used for connecting structures on a corner or a substantially planar surface (e.g. paperboard panels) that do not contain complex three dimensional shapes. Furthermore, when the tab is inserted into an opening during engagement, it is difficult to operate without folding or creasing the tab which may lead to a source of weakness when loading force is applied.

Accordingly, there is a need for improved means for connecting container parts together that reduce the use of adhesives while improving the overall strength, performance and the recyclability properties of the container.

SUMMARY OF THE INVENTION

The embodiments described herein can address the above need by providing inter-connecting methods and apparatuses that can mechanically connect multiple parts of a container together. The container may be formed by multiple parts. The inter-connecting method can be used for containers made of different recyclable and compostable materials.

In one aspect, the present invention provides methods and apparatuses of an improved inter-connecting means for a multi-part container. The inter-connecting means may utilize a plurality of locking features formed along the edges of one part of the container to be mechanically secured in a plurality of complimentary locking features formed in a portion of the other part of the container. When the multiple parts are in an assembled configuration, the locking features are disposed in an enclosure of the container and form a smooth seam on the outer surface of the container.

In some embodiments, the first edge or the second edge comprises a curved segment. In some embodiments, one or more of the plurality of inter-connecting tabs and slits are formed in a shoulder area of the container. In some embodiments, the plurality of inter-connecting tabs and slits have varied shapes, sizes or spacing along the first edge. Alternatively, the inter-connecting features comprises a plurality of tabs and slits that have the same size and shape as the inter-connecting tabs and slits on the first edge. In some cases, the inter-connecting features comprise a plurality of slots. In some examples, the plurality of slots has a D shape.

In some embodiments, the engaged inter-connecting tabs are aligned to an inner surface of the container. In some instances, the inner surface is a curved surface.

In some embodiments, the first shell part and the second shell part are formed from a recycled or biodegradable pulp material. For example, the pulp material is selected from the group of wood pulp and paper pulp. In some instances, the first shell part and the second shell part form a skeleton shell of the container and wherein the skeleton shell is 100% recyclable. In some cases, the first shell part and the second shell part are molded then cut to form the plurality of inter-connecting tabs and slits, or the inter-connecting features. In some embodiments, the multi-parts container further comprises a fitment and a neck to support the fitment. In some cases, the fitment comprises one or more interlock features configured to mate one or more complementary features at the neck.

In another aspect, a single-piece container is provided. The container may comprise: a single pulp-molded open shell having two or more sides to be joined together, wherein at least a first side of the two or more sides comprises a plurality of inter-connecting tabs and slits, and a second side to be connected with the first side comprises a plurality of inter-connecting features, and when the first side and the second side are jointed together, the plurality of inter-connecting tabs are disposed in an internal region of the container. In some cases, the inter-connecting features comprise a plurality of D shaped slots or a plurality of inter-connecting tabs and slits.

In some embodiments, the first side or the second side comprises a curved profile. In some embodiments, the container is formed from a recycled or biodegradable pulp material.

In another aspect, the present invention provides methods and apparatuses for connecting molded pulp, fiber or paper parts together. This can be single shells being joined together, or hinged shells that are connected along a hinge. In some embodiments, the connecting may not require glue. This can allow for the manufacture of cost-effective high volume containers. This approach removes or reduces the adhesive thereby improving the strength, performance and recyclability of the container.

In another aspect, the present invention provides methods to make molded pulp, fiber or paper shell containers that do not comprise a liner. In this case, the container can be of highly recyclable single material which can be compostable and/or recyclable. In another aspect, there may be a fitment for engaging a cap or cover but with no liner. In some cases, this container may be used for holding powders, particulates or other materials.

In a different yet related aspect, the present invention provides a high barrier or water proof container using one of the many forms of liners, liners with attached fitments, single part liners with integral fitment features, or coatings that are encapsulated by mechanically inter-connecting pulp shells. Accordingly, the outer shell can be separated to be recycled and the plastic liner can be disposed or recycled as applicable.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

In the following detailed description, numerous specific details are set forth in order to provide a thorough understanding of the invention. However it will be understood by those of ordinary skill in the art that the invention may be practiced without these specific details. In other instances, well-known methods, procedures, and components have not been described in detail so as not to obscure the invention. Various modifications to the described embodiments will be apparent to those with skill in the art, and the general principles defined herein may be applied to other embodiments. The invention is not intended to be limited to the particular embodiments shown and described.

The invention described herein provides inter-connecting methods and systems that can mechanically connect multiple parts of a container together to form a uniform singular structure.

The containers described herein can be used for the delivery and/or storage of materials for human consumption or for the delivery of other materials not for human consumption. In some cases, the contained materials can be solid such as powders or granules, tablets and other particulates. In other cases, the material can be liquid. In these cases, the container may further comprise a liquid-holding vessel or bag. Examples of materials that can be contained include beverages, syrups, concentrates, soaps, inks, gels, solids, and powders.

In some embodiments of the invention, the container may have a fiber or pulp-molded body. The fiber and pulp-molded body can be a hollow shell comprising two or more pieces connected together. In some embodiments, the two or more pieces of the shell may be securely connected via internal inter-connecting features.

Figure 1:
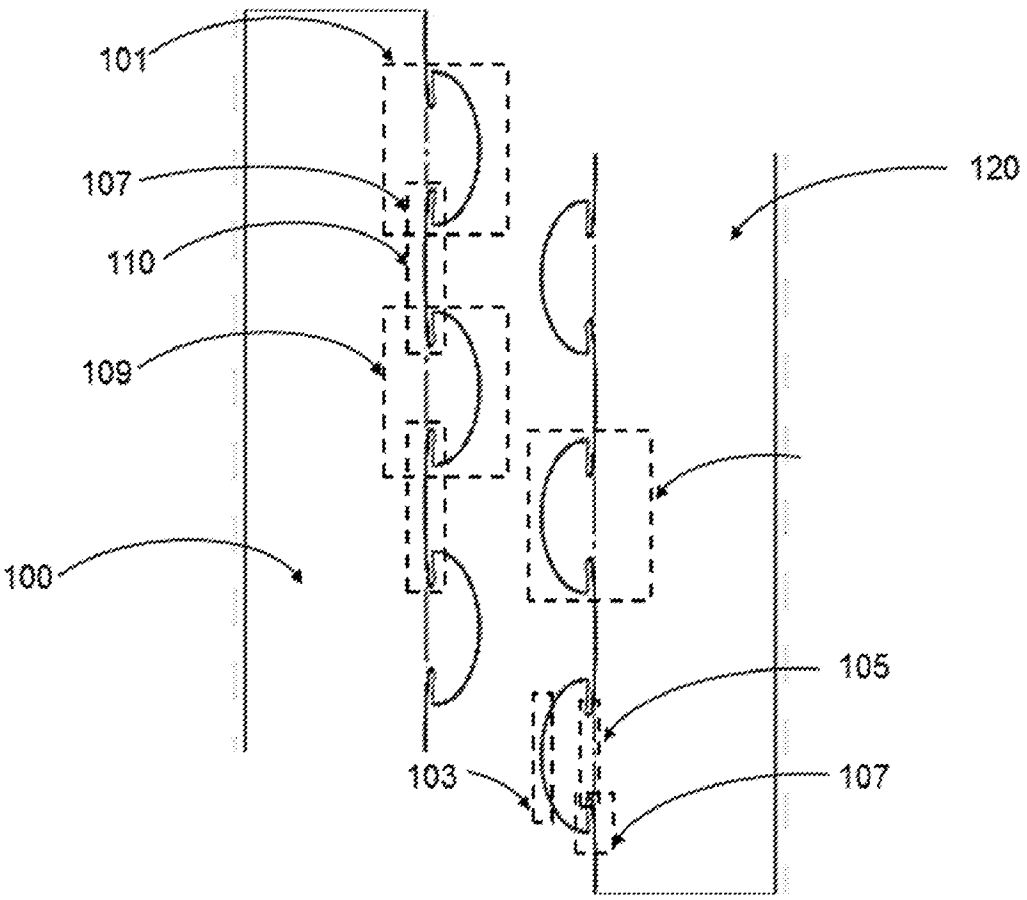
FIG. 1 provides a fragmentary view of a portion of two container pieces comprising an exemplary internal inter-connecting structure.

FIG. 1 provides a fragmentary view of a portion of two container pieces comprising an exemplary internal inter-connecting structure. As shown in FIG. 1, the internal inter-connecting structure may comprise a plurality of internal inter-connecting tab portions 101 and inter-connecting slit portions 110 that are disposed along an edge of a first piece of a container shell 100. In some embodiments, a plurality of inter-connecting tab portions 101 are interspersed between a plurality of inter-connecting slit portions 110 that are formed on the same edge and an overlapping portion 107 may be formed by the adjoining tab potion 101 and slit portion 110. In some embodiments, a second piece of the containing shell 120 may comprise identical inter-connecting features along an edge that is to be mated with the edge of the first piece. The plurality of internal inter-connecting tab portions 101 can be designed to be inserted through a plurality of mating lineal slit portions in the second piece to form a secure locking configuration.

Figure 4:
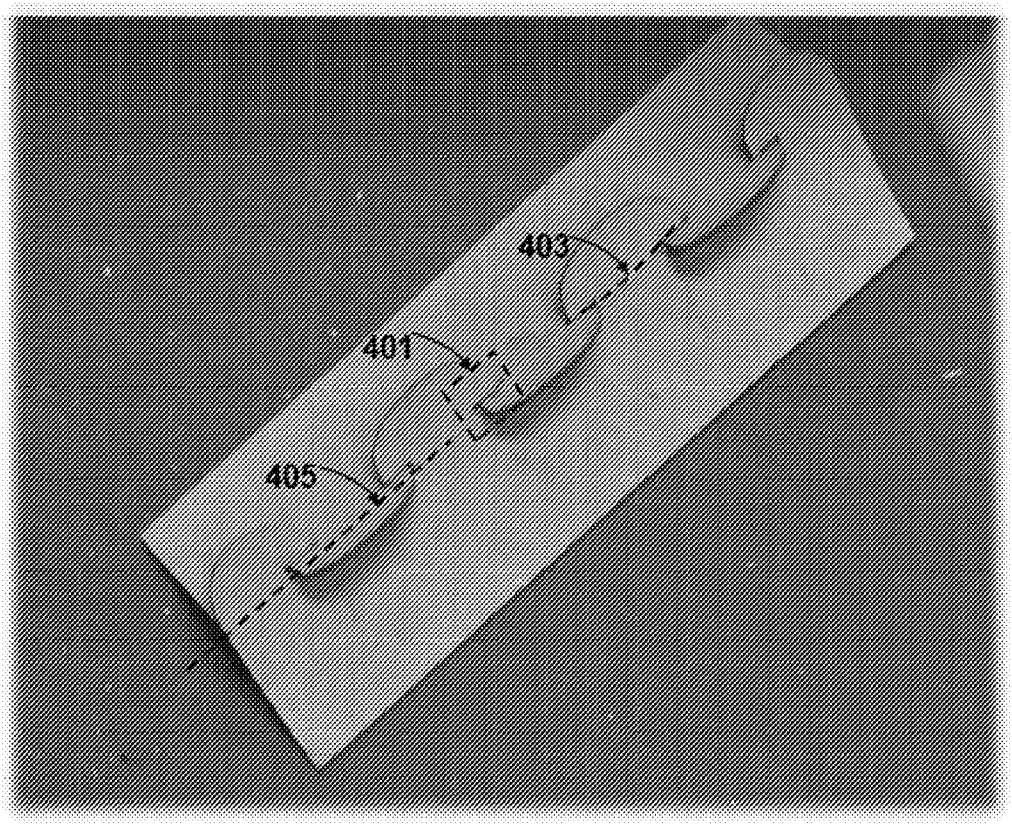
FIG. 4 shows an example of a portion of two pulp-molded parts connected via inter-connecting structure, in accordance with some embodiments.

The internal inter-connecting tab portions 101 as depicted in FIG. 1 may also be referred to as mushroom shaped inter-connecting tab features. In some embodiments, the mushroom shaped inter-connecting tab features 101 may comprise a leading portion 103, a root portion 105 and an undercut portion 107. The leading portion 103 may be designed to aid in guiding the tab feature entering into the complimentary slit 110 during manual or automated assembly. The undercut portion 107 may be designed such that once they are in a locked configuration, it may interfere with the undercut portions of the mating tabs such that the contacting edges of two pieces are prevented from separation (as shown in FIG. 4). In some cases, edges in the undercut portion 107 may bear against forces that are pulling the two pieces of connecting edges apart applied by the interfering tabs. In some cases, after the plurality of internal inter-connecting tabs engaged with the lineal slits, the undercut portion 107 can provide a secure lock that prevents a relative movement between the tabs and slits in one, two, three or more directions.

As depicted in FIG. 1, the internal inter-connecting tab features may have a mushroom shape to be overlapped with another piece of the container. In some embodiments, the leading portion 103 of the inter-connecting tab feature may have different configurations such as semi-circular, arrow type or a T shape. The shape of the tab feature needs not be symmetrical. For example, a half of the tab feature can have a different shape or size from the other half such that the tab may have a lead-in feature off the center. Accordingly, the entering angle during engagement of the locking features may alternate based on the shaped lead-in features. In some embodiments, centered or off-centered leading portion that is used for guiding insertion of the inter-connecting tabs through the complimentary slits may affect the range of entering angles during engagement.

In another example, the undercut portions from the two sides of one inter-connecting tab may not be identical. For instance, the undercut portion from one side may be shorter than the other side in length. In other instances, the undercut portion may be present only on one side. The internal inter-connecting tabs to be inserted through the complimentary features can have various shapes as long as there are interference edges for bearing non-friction contacting forces between a pair of locking features. Other shapes, such as hook-shapes, L-shapes, Y-shapes, T-shapes, triangular and diamond etc, can be used to secure the inter-connecting tabs with the complimentary features (see FIG. 2 Part B). In some embodiments, the inter-connecting tab features on the same side of the container part need not be identical. For example, the inter-connecting tab feature 101 may be in a mushroom shape whereas the neighboring tab feature 109 may be in a T-shape.

As depicted in FIG. 1, the root portion 105 and the undercut portion 107 of neighboring inter-connecting tab features define the slit portion 110. The slit portion as depicted in FIG. 1, may also be referred to as overlapping lineal slit portion. In some embodiments, the undercut portion 107 of the inter-connecting tab feature may be a portion of the overlapping lineal slit potion 110 such that the undercut portion is shared by the inter-connecting tab potion 101 and the neighboring slit potion 110. In some embodiments, the undercut portion 107 may be the region where a pair of locking tab features interferes with each other when they are in a locked configuration. The pitch and shape of the slits portion may be designed to match the location of the mating tab portions.

Figure 2:
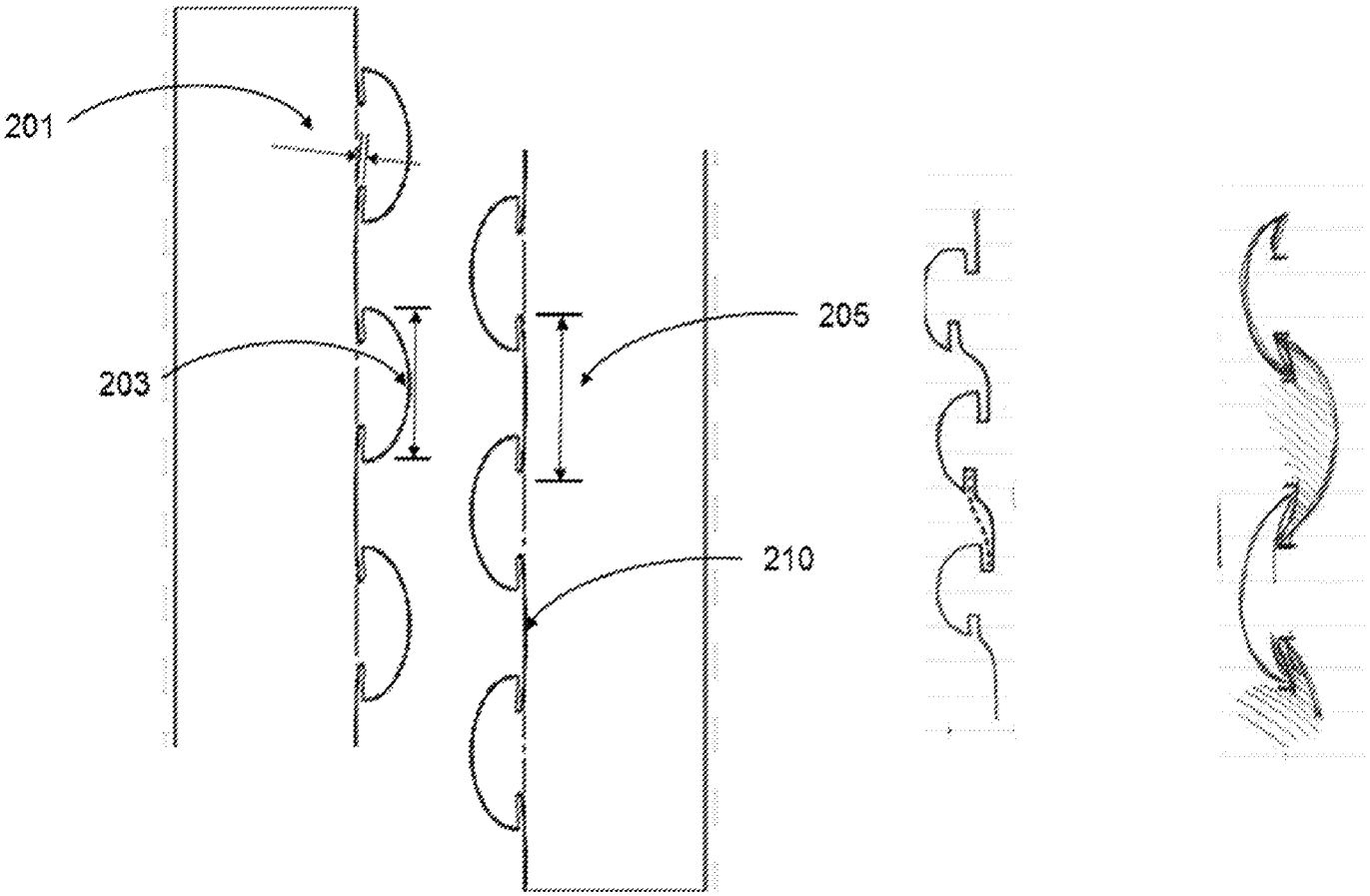
FIG. 2 shows an example of inter-connecting structure with oversized slit features, in accordance with some embodiments.

In some embodiments, the overlapping lineal slits feature may have a curved profile 210 as shown in FIG. 2 Part A. The profile of the overlapping lineal slit feature may be a convex curve with any suitable curvature. In other embodiments, the profile of the overlapping lineal slit feature may have various shape, such as straight line, wavy, or a concave curve (i.e. curve in the opposite direction of 210). In other embodiments the overlapping lineal slits may be staggered and would force the mating tab to flex in order to pass through it and this can result in different locking performance (as shown in FIG. 2 Part B). The overlapping slit feature may adopt various shapes to provide contacting edges for securing the mating tab features in place. The overlapping lineal slit feature may have a thickness 201. Thickness of the overlapping lineal slit feature 201 may be determined by the undercut portion of a neighboring inter-connecting tab feature. In some embodiments, the thickness of the overlapping lineal slit feature may be substantially equivalent to the thickness of the pulp material at the tab feature which may further provide a solid feel at the inter-connecting features. The thickness of the pulp material may be, for example, in a range from 0.3 mm to 8 mm. The thickness of the pulp material may be at least 0.1 mm, 0.2 mm, 0.3 mm, 0.5 mm, 0.7 mm, 1 mm, 2 mm, 3 mm, 4 mm, 5 mm, 6 mm, 7 mm, 8 mm, 9 mm, 10 mm and the like. Alternatively or in addition, the thickness of the pulp material may be no more than 0.2 mm, 0.3 mm, 0.5 mm, 0.7 mm, 1 mm, 2 mm, 3 mm, 4 mm, 5 mm, 6 mm, 7 mm, 8 mm, 9 mm, 10 mm, 20 mm and the like. The thickness of the pulp material may or may not be uniform across the container. For instance, the container shell may have a first wall thickness in the upper areas of the shell and a second wall thickness in other areas. The thickness may be controlled by a pulp-molding process. Controlling the pulp thickness is critical in terms of the integration of two container shells engaged together as well as the ease of assembly.

In some cases, the thickness of the overlapping lineal slit may be increased to permit the inter-connecting tabs to pass through with minimum or less resistance. In some cases, when the inter-connecting tab features are entering the mating lineal slit features, the slit features may be opened to certain extent for receiving the tab features with minimum interference. In some cases, pulp shells with varying thicknesses may pass through a given lineal slit with reduced interference. For instance, a tab feature with varying thickness may be inserted into a slit or slot with a constant thickness. Decreasing this interference with larger slits results in the assembled bottle results in larger visible external gaps between assembled shells. This can be undesirable in some instances where aesthetics are important or container integrity of linerless containers is important. These gaps may become more visible when the assembled shells are forced apart and the shells separate to the point where the back edges of the tabs of opposing shells contact each other to resist separation of the shells. The thickness dimension of the lineal slot and other dimensions are important to provide a desired bottle performance.

In some embodiments, the lineal inter-connecting slit features need not be formed in conjunction with the neighboring inter-connecting tab features. For example, instead of a plurality of slit features formed on the edge that are interspersed between the inter-connecting tab features, only the slit features may be included in a portion of a container piece, such as the inter-connecting features in FIG. 6. The lineal slit feature may or may not be formed at the edge of the container piece. In some embodiments, additional features may be adopted such as a slit (e.g., 609 in FIG. 6). The slit 609 may allow for a bigger opening during engagement process such that the resistance force can be reduced.

FIG. 2 shows an example of inter-connecting structure with oversized slit features, in accordance with some embodiments. The design of slit features with greater width than the width of the tab features (i.e. undersized inter-connecting tab features) may allow for an engagement process with minimum resistance. As depicted in FIG. 2, the mushroom shaped inter-connecting tabs may have a maximum width 203 which is smaller than the width of the complimentary lineal slit 205. The greater width of the lineal slit feature may permit the inter-connecting tab feature passing through the slit with less interference or resistance force. The amount of the width difference between the tab feature and the mating slit feature could be any number as long as an overlapping portion for engagement (e.g., 107 in FIG. 1) is provided and the root portion of the tab feature is not weakened. In some embodiments, the overlapping portion may be varied in dimension to improve the strength of the engagement. In some embodiments, the width of the root portion may be increased to ensure the strength or stiffness of the inter-connecting tab features. There is a tradeoff between the width of the root of the tab and the width of the slot considering a fixed pitch between features. A wider slot can help shell assembly and accommodate misalignment between one shell as it is engaged with the other shell. In some instances, the two sides to be connected together may comprise the same inter-connecting features such that the slits on one side may be the same as the slits on the opposing side. In this case, the inter-connecting tab features may have a width the same as or slightly smaller than the width of the slit features formed on the same side. In alternative instances, the two sides to be connected together may comprise different inter-connecting features such that the slits on one side need not be the same as the slits on the opposing side. In this case, the inter-connecting tab features may have a width smaller than, equivalent to, to greater than the slits formed on the same side.

Figure 3:
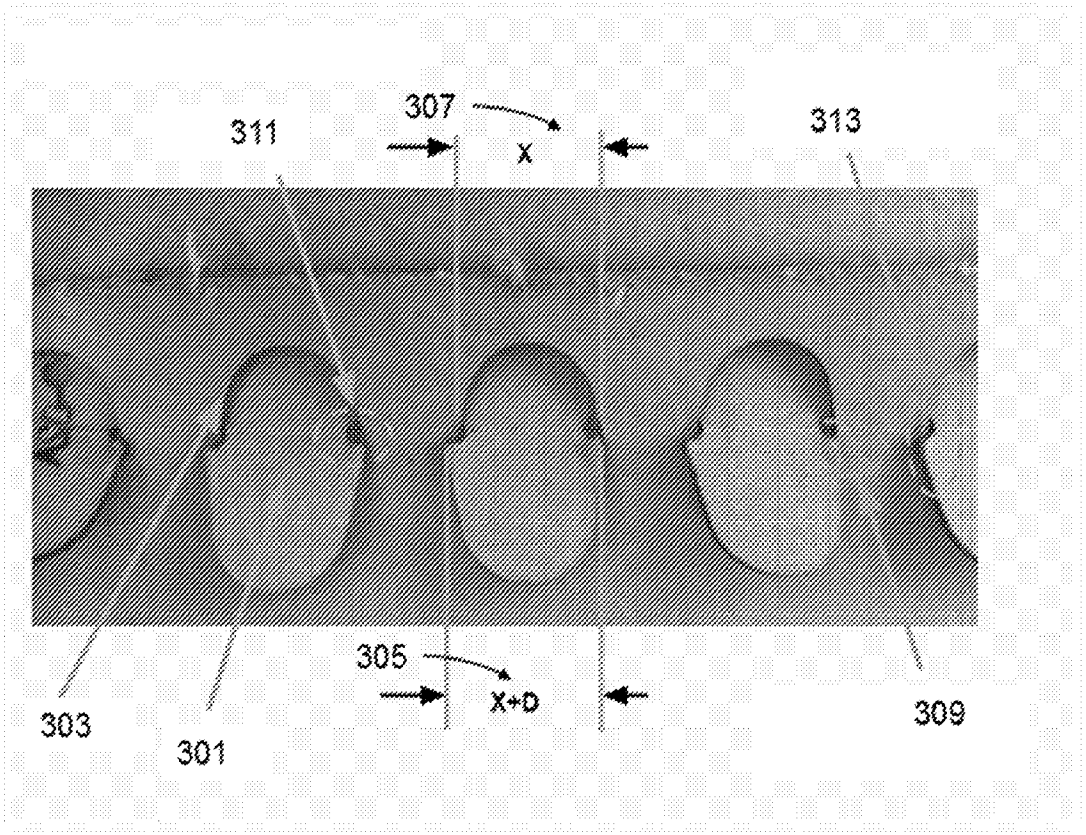
FIG. 3 provides a fragmentary view of another example of inter-connecting structure.

FIG. 3 provides a fragmentary view of another example of inter-connecting structure. As shown in FIG. 3, the internal inter-connecting structure may comprise a plurality of internal inter-connecting tab features 301 that are disposed along an edge of one piece of a container shell and a plurality of slot features 303 disposed close to an edge of another piece of the container shell. The location of the slot features 303 with respect to the edge of the shell piece determines an overlapping region where a dual-wall feature forms. In the case where greater region of dual or multiple walls is preferred, the location of the inter-connecting slots can be arranged further away from the edge of the shell piece.

In some embodiments, the inter-connecting slots may have a D-shape with a maximum width 307 smaller than the maximum width 305 of the mating inter-connecting tab features. In this case, the inter-connecting tab feature may be lightly deformed when it is passing through the inter-connecting slot opening 309 as indicated in FIG. 3. The width of the inter-connecting tab feature may be greater than the maximum width of the slot by a width difference D. The width difference may be designed such that when the inter-connecting features in a locked configuration, the tab feature interferes with the edges of the slot thus preventing the connected shell pieces from separation. In the meantime, the width difference may be designed to provide a desired flexibility such that the tab is allowed to deform to certain extent when it is passing through the slot.

Once the inter-connecting tab feature passes through the slot opening, the undercut portion of the tab feature may spring back to form a lock between the two shell pieces. In some instances, a gap may be visible 311 in the locked inter-connecting features. The undercut portion 107 may be designed such that the once they are in a locked configuration, it may interfere with the undercut portions of the mating tabs such that the contacting edges of two pieces are prevented from separation 313 of the tab features as described elsewhere herein may be designed such that the once they are in a locked configuration, it may interfere with the edge of the D-shaped slot such that the contacting edges of two pieces are prevented from separation.

In some embodiments, additional features may be provided to help compress or flex the tab features when they move through the undersized inter-connecting slots. For example, a longitudinal slit in the inter-connecting tab may be used to allow for a flexible deformation of the inter-connecting tab during insertion without forming a permanent deformation or crease.

FIG. 4 shows an example of a portion of two pulp-molded parts connected via inter-connecting structure, in accordance with some embodiments. As shown in FIG. 4, a plurality of internal inter-connecting tab features and overlapping lineal slits are assembled along the edges of two pulp-molded parts. The plurality of inter-connecting features may be identical on the connecting edges from the separate parts where the two parts meet. Once the inter-connecting features are in the locked configuration, a plurality of contacting edges and surfaces such as in the overlapping portion 401 and the lineal slits portion 403 may be configured to ensure a strong bonding between the two parts. The plurality of inter-connecting features can help distribute loading forces such that the force applied to each pair of inter-connecting features is reduced and splitting the two pieces apart at the seams under the load may be prevented. In some embodiments, the plurality of assembled inter-connecting features may be configured to effectively prevent substantial relative motion in any direction, such as translational movement or rotational movement. In some embodiments, the two connected pieces may be permitted to have a relative rotational movement about the axis 405 along the contacting edges. The flexibility of adjusting rotational angles about the axis 405 may allow the inter-connecting tabs transit from an engagement configuration to a locked configuration. Once the inter-connecting tabs along one side of the container shell are in the locked configuration, the movement about axis 405 can be restricted by engagement of the other side of the container shell.

Figure 5:
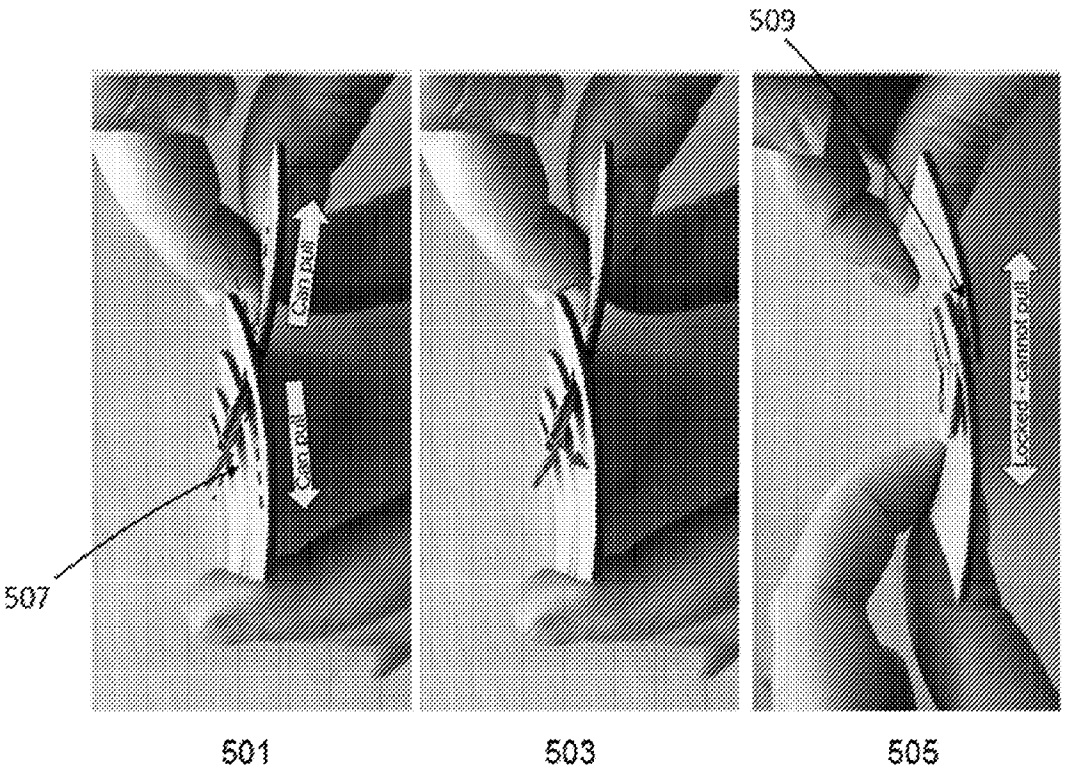
FIG. 5 illustrates an exemplary process of engaging a plurality of inter-connecting features.

FIG. 5 illustrates an exemplary process of engaging a plurality of inter-connecting features. As shown in FIG. 5, the internal inter-connecting tabs from one part of the shell may be inserted into the complimentary slits in a direction not aligned with the plane of the mating part 501. The engagement angle 507 may define a direction of the engagement movement between the two shell parts. In some cases, the tab features on one shell part may enter the slot features on the mating part from the outer surface of the mating part at the engagement angle. The engagement movement may be performed by moving either of the shell parts or both. Once the inter-connecting features pass through each other, the inter-connecting tabs may be sticking out from the bottle inner surface and then flex back to the inner surface of the shell part 503. Once the inter-connecting tabs completely spring back, or are forced back, they may be in a locked configuration 505. The hooked portion of each inter-connecting feature bears against a pulling force and a secure locking engagement between the two parts is in effect. As shown in FIG. 5, the engaged inter-connecting features are formed close to an inner surface of the container shell 505. Surface of locked inter-connecting features may be substantially aligned with each 509. In some embodiments, the inter-connecting tabs are formed in a curve surface as an extending portion of a shell part such that the inter-connecting tabs may be able to align with the other shell part from the inner surface when they are in the locked configuration. It can be understood that as the material thickness increases there is more surface contact between the hooked features. This distributes the pulling force over more hook surface. Similarly, thicker material can allow the system to perform, resist pulling forces, despite the hook portion of the tabs being somewhat misaligned where the additional material thickness ensures a degree of contact between hooks does remain. Contemplated are, features formed in the hooks that serve to increase the surface contact between hooks or to accommodate some misalignment but without increasing the wall thickness. It is advantageous to reduce the wall thickness from an environmental perspective and in such case forming of features to improve resistance to separation from pulling is contemplated. Achieving increased surface for resistance could include the use of folding, adding material locally, or local offsetting of the pulp shell material.

Figure 6:
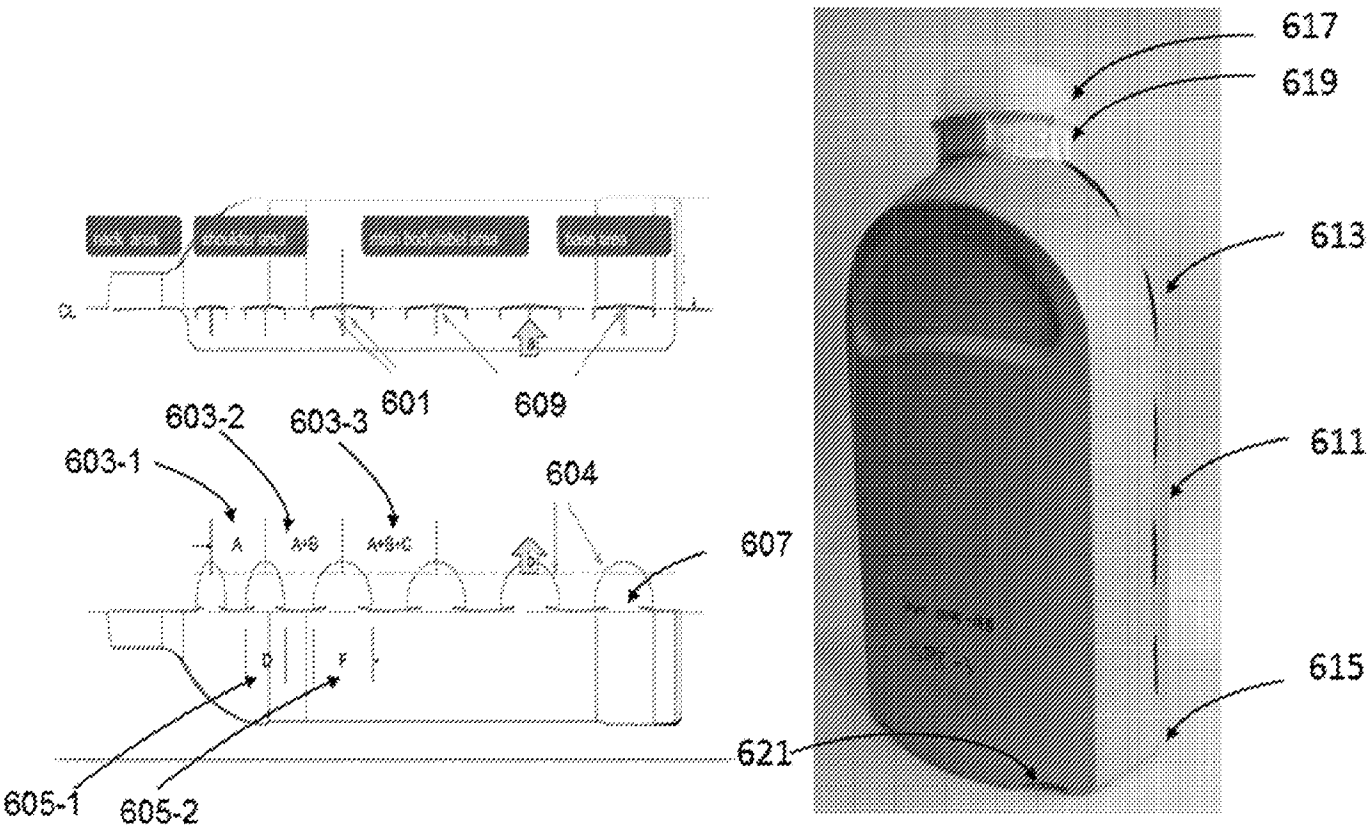
FIG. 6 provides a side view of inter-connecting features formed along edges of two pieces of container shells including the curved edges at the shoulders of the container.

FIG. 6 provides a side view of inter-connecting features formed along edges of two pieces of a container shell. As shown in FIG. 6, the inter-connecting tab features 604 on one piece and the complimentary inter-connecting slit features 609 on the other piece may be engaged to secure an assembly of the container shell. As depicted in FIG. 6 Part A, the inter-connecting tab/slit features need not be evenly spaced. In some embodiments, the spacing or pitch of the inter-connecting features may be designed for best performance and aesthetic effect. In some embodiments, the pitch or spacing of the inter-connecting features may vary in response to the curvature of the surface or the side of the shell piece. For example, in the shoulder area, where the profile of the bottle transitions from the side wall to the neck area, or other area with a profile change, the pitch or spacing 603-1, 603-2 may be decreased compared to the pitch or spacing 603-3 in the area where the curvature is small. In some embodiments, the size and/or shape of the inter-connecting features need not be uniform. The dimension and/or shape of the inter-connecting tab/slit features may or may not be varied according to the curvature or contour of the container shell. In some instances, a width of the tab or slit/slot features may vary according to the curvature or contour of the side where the inter-connecting features are formed. For example, wide inter-connecting tab features 607 may be located along a straight side and narrow inter-connecting tab features 605-1, 605-2 may be located along a curved side, such as the shoulder area or corners of the bottle. The relatively smaller size and/or pitch of the inter-connecting features may provide flexibility to accommodate various curvatures and contours. Altered pitch and sizes of interconnected features could also be applied along straight sides. Accordingly, on a single side of a piece of container, one, two, three or more different shapes and/or sizes of inter-connecting features may be included.

As mentioned above, the pitch or spacing of inter-connecting features on a single side of a piece of container may or may not be uniform. The shape or size of the inter-connecting features on a single side of a piece of container may or may not be constant. The inter-connecting features on a single side of a container may vary in at least one of the following: shape, size, spacing or pitch. Alternatively, the inter-connecting features on a single side of a container may be constant.

FIG. 6 Part B shows an assembled container with connected inter-connecting features. As shown in the figure, the inter-connecting tab/slit features can be formed along straight edge 611, curved profile 613 (e.g., shoulder area) and corners 615. A cross-section of the inter-connecting tab feature may have a curvilinear shape when it is formed in a region with curved profile. In some embodiments, the inter-connecting tabs are formed in a curved surface as an extending portion of a shell part such as the inter-connecting tabs formed in the shoulder region. The formed inter-connecting features may then have a curved surface following the curvature of the shell piece. The formed inter-connecting features may have a curved shape in one or more directions. For instance, the inter-connecting features may be curved in a direction along with a side of the container, a direction perpendicular to the side of the container or a combination of both. The assembled inter-connecting features may be aligned with a surface that may or may not be a flat planar surface. For example, when the container has a rectangular shaped cross-section, the inter-connecting features may be formed and assembled on a substantially planer surface. In another example, when the container has a cylindrical shape, the inter-connecting features may be formed and assembled on a curved surface. The inter-connecting features can be formed in a surface curved in one or more directions. The surface may be curved in a direction along the longitudinal axis of the container, in a direction perpendicular to the longitudinal axis (e.g., side wall of a cylindrical shaped container), or a combination of both (e.g., shoulder area of a cylindrical shaped container).

In some cases, a container may be assembled using inter-connecting features only. In this case, no glues or additional materials included in the container shell, the described inter-connecting method and system provides a highly recyclable single material container which can be completely compostable and/or recyclable. In some cases, a portion of the sides to be connected may be connected using the inter-connecting features. For instance, at least 10%, 20%, 30%, 40%, 50%, 60%, 70%, 80%, 90% of the sides are connected using the inter-connecting features.

Figure 7:
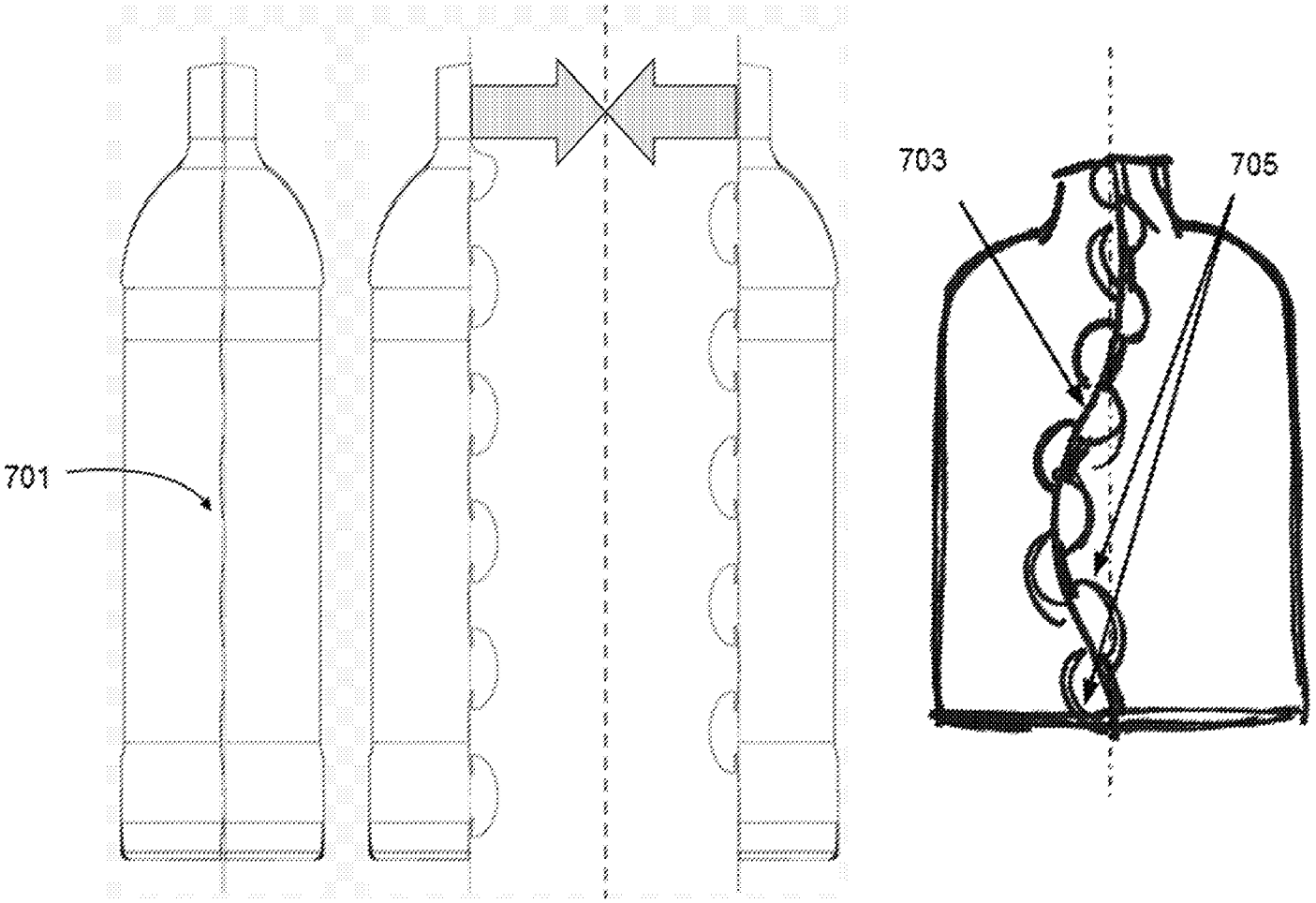
FIG. 7 provides an example of a container comprising two parts connected by inter-connecting structures, in accordance with some embodiments.

In some embodiments, multiple fiber or pulp-molded parts can be connected via the provided inter-connecting means to form a container with a hollow body for filling. FIG. 7 provides examples of a container comprising two parts connected by a plurality of inter-connecting features, in accordance with some embodiments. As shown in FIG. 7 Part A, when the two pieces of the container assembled, the inter-connecting features are disposed in an enclosure region of the container so that they are not visible from the external of the container. As described previously, once the two pieces are in a fixed locking configuration, the inter-connecting features may be substantially aligned with an inner surface of the container. In some embodiments, adhesive could be used to retain the assembled tabs to the inner surface if additional robustness of the container is required. In some embodiments, a smooth seam 701 may be observed from the outer surface of the container. The seam observed from the outer surface of the container may be formed by a plurality of inter-connecting slits or edges of the slots. Accordingly, adjusting the profile, spacing and/or pitch of the slit or slot features may achieve various aesthetic effect.

In some embodiments, a plurality of inter-connecting features may be disposed along an edge of a piece of the container. The plurality of inter-connecting features can be located anywhere on the shell piece. FIG. 7 provides a side view of the internal inter-connecting features along the side of the container. However, the location should not be limited to the sides of the container. In some embodiments, the inter-connecting features may be formed on the bottom, top, sides of the container. The edge which the inter-connecting features 705 formed at or close to need not be a straight line. For example, the edge can have a curve profile 703 (FIG. 7 Part B), a triangular shape or not parallel to the longitudinal axis of the bottle when it is on the side wall. Accordingly, the inter-connecting slit/slot features on the same edge may not be aligned with each other. The profile of the seam as visualized from the external of the bottle can thus be further adjusted for an aesthetic effect and best performance.

The inter-connecting features can be formed along an entire side of a shell piece or a portion of the side. For example, the inter-connecting features can be formed only on the lower half of the edge and the upper half of the edge can be connected through other connecting means. It should be noted that various combination of connecting means can be used for connecting multiple shell pieces, even on a single side. For instance, a portion of the side can be connected using adhesion and another portion can be connected using the described inter-connecting features. In other instances, other attachment means such as heat sealing, adhesive or non-adhesive tape, sealing wax or snaps can be used in addition to the described inter-connecting method to provide additional sealing or connection. However, when no other materials included in the container, the described inter-connecting method and system provides a highly recyclable single material container which can be completely compostable and/or recyclable.

In some embodiments, two mating pieces may have identical inter-connecting features such as the internal inter-connecting tabs and overlapping lineal slits as described in FIG. 1. In other embodiments, the mating pieces of a container may have different inter-connecting features for each piece on a connecting side such as the embodiment in FIG. 6. For example, on one mating side where two pieces of container connected, an edge of a piece of the container shell may comprise a plurality of inter-connecting tabs while the mating portion of the other piece of the container shell may comprise a plurality of complimentary inter-connecting slots (e.g., inter-connecting features in FIG. 4). For a single piece of a container shell that has two sides to be connected, the piece may have the inter-connecting tabs on one side and the inter-connecting slots on the other side. Alternatively, the piece of container shell may have either the inter-connecting tabs or the inter-connecting slots on both sides. In some cases an inter-connecting mushroom feature may not be required for every tab feature. A number of simple tab features without the need to be interlocked could more easily follow a tightly curved profile in the container. These simple tabs could then have inter-connecting mushroom tabs before and after in order to retain the shells together.

Figure 8:
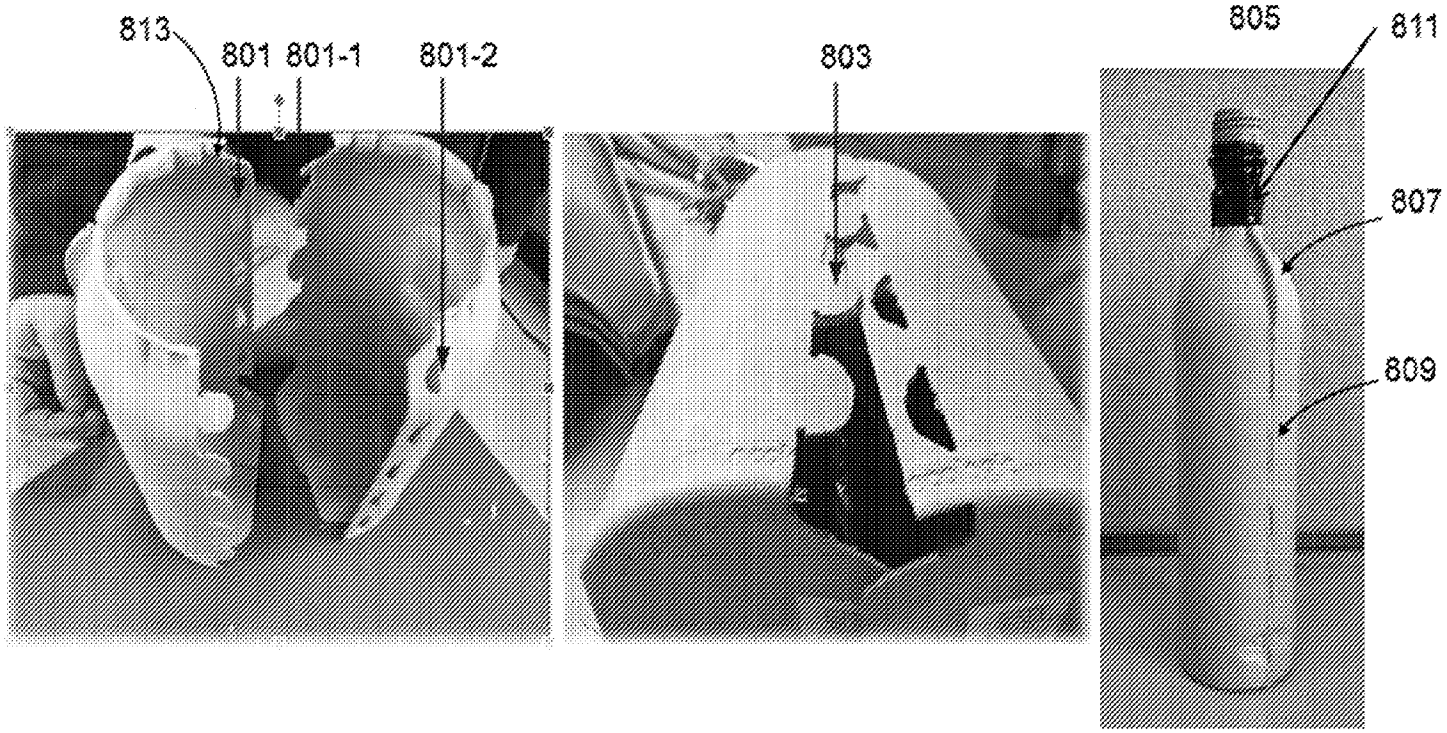
FIG. 8 provides an example of a pulp-molded container shell comprising multiple parts connected by inter-connecting structures, in accordance with some embodiments.

FIG. 8 provides an example of a fiber or pulp-molded container shell comprising multiple parts connected by inter-connecting structures. The inter-connecting structures as described herein may comprise a plurality of internal inter-connecting tabs and inter-connecting slits/slots that once the parts are connected, the engaged inter-connecting features/tabs are disposed in an internal region of the container 803. In some embodiments, a single part of the container may have inter-connecting features on one, two, three or more edges. These inter-connecting features may or may not be uniform features on each edge or all the edges. In some embodiments, the part may have the internal inter-connecting tabs 801-1 on one side and inter-connecting slits or slots 801-2 on the other side. The inter-connecting tabs and the inter-connecting slits or slots formed on the same shell part may or may not be mating features. In some cases, as shown in FIG. 8, the tabs and slots formed on a single shell part may be mating features for each other that may allow two identical shell parts to be connected to each other. This may be beneficial for simplifying manufacturing process.

As shown in FIG. 8, the inter-connecting features may be located anywhere of the container, such as the shoulder, neck, corner and bottom of the container. A connected edge may comprise various combinations of attachment means. Multiple parts of the container need not be joined together having the internal inter-connecting features along the full length of the joining edges. For example, a joining edge may have internal inter-connecting features on a portion to form a smooth mechanical connection, while the other portions may be joined by other types of connecting features such as flange, lug features, overlap flaps, hinged overlap flaps, etc. As shown in FIG. 8, other connecting means may be used to join multiple parts together to form an assembled container 805. As depicted in FIG. 8, the container may have flanged side 807 on one portion and smooth mechanical inter-connecting side 809 on the other portion.

In some embodiments, the pulp-molded container shell may comprise molded features on the neck to accept a lid, membrane, cap, twist cap, snap cap, or even a threaded cap directly. There could be locking features molded into the pulp such as 813 in FIG. 8. There could be complimentary features in the fitment to be mated with the locking features 813 such that the fitment can be fixed to the shell body meanwhile providing a through-hole access to the contents of the container. The fitment may or may not have threaded features to receive a lid (e.g. 617 in FIG. 6 Part B). The fitment may or may not be formed from the same material as the shell body. The fitment may be formed from a material that may provide greater options for shaping or detailing than the shell body. In some embodiments, the fitment may be formed from molded or formed pulp or fiber. The cap may be formed from thermoformed pulp or fiber. A lid or cap may be provided over the fitment. The lid may be removable or replaceable. The fitment and its connection to the shell may be connected physically to reduce the forces of lid removal and installation including rotational, pulling and pushing forces. The interlock tabs 813 may contact the fitment and serve to reduce movement of the fitment due to these forces.

Figure 21:
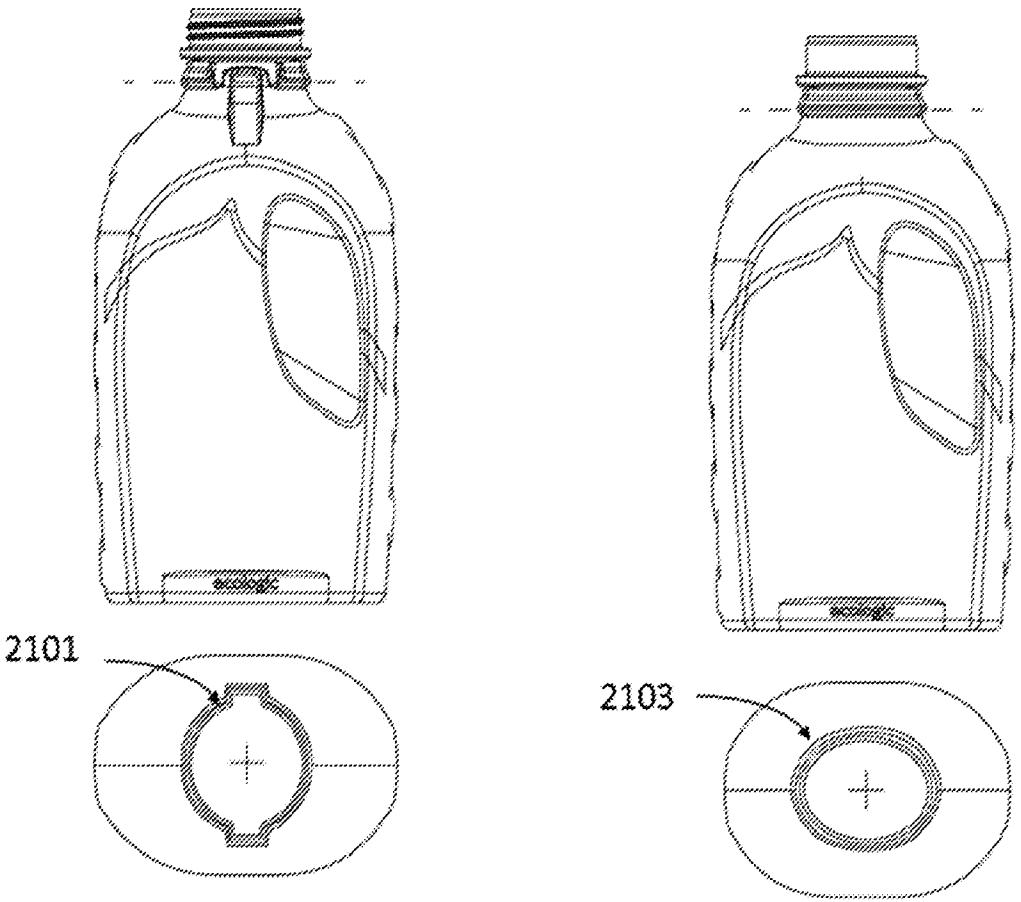
FIG. 21 shows examples of containers comprising a liner with fitment feature.

In alternatively embodiments, the fitment may be prevented from having a rotational movement relative to the container by a non-circular cross-sectional shape of the container at the neck. In some cases, interlock tabs as described above may not be required at the neck of the container. FIG. 21 shows examples of container with non-circular cross-sections 2101, 2103 at the neck. A rotational movement between fitment and the connected container may be prevented by a non-circular cross-section at the mating region. For example, the cross sectional shape of the fitment at the neck may be non-circular and the container shell to be mated with the fitment may have a mating shape which is also non-circular, so that the fitment is prevented from rotating relative to the container at the neck. The cross-section of the fitment and the neck of the container can have any non-circular shape, including but not limited to, elliptical, rectangular, wedge shape, irregular shape, and various others. It should be noted that the fitment as described could be an independent fitment, a fitment connected to a pouch, or a fitment feature that is integral to a liner.

Figure 22:
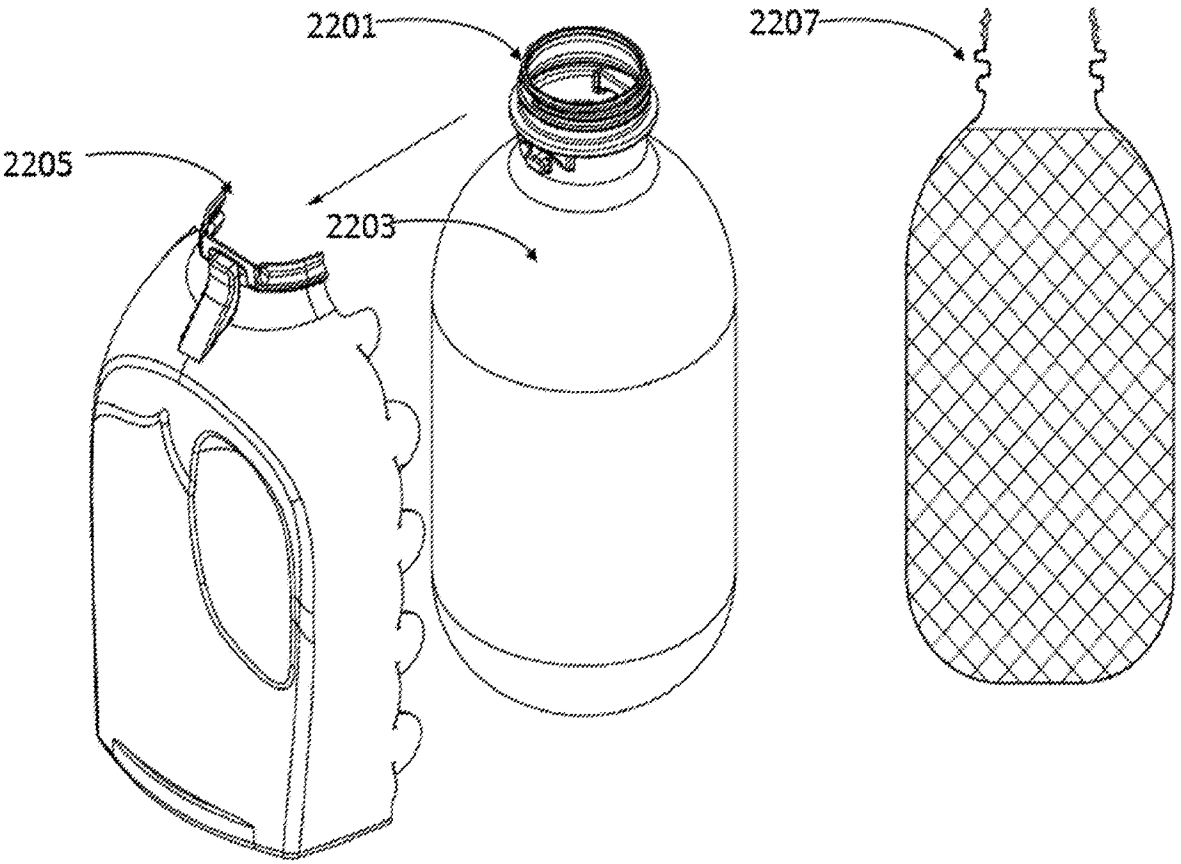
FIG. 22 shows examples of containers having a cross-section to prevent a rotation of the liner.

FIG. 22 shows examples of container comprising a liner 2203 with integral fitment 2201. As illustrated in the figure, a blow-molded liner 2203 with an integral fitment 2201 may be integrated to a pulp-molded container shell 2205. The fitment may comprise features such as thread 2207 to connect to the container shell. The liner can be formed from a blow molding process. Blow molding processes may include but not limited to, Injection Blow, Stretch Blow, Parison Blow and Extrusion Blow molding. The liner may be attached to the fitment by various manufacturing methods such as induction welding. For instance, when the fitment contains a metal film or foil, radio frequency (RF) energy is used after the filling of the container to seal the fitment to the liner with the heat energy generated from the RF interacting with the metal foil. The heat generated by the RF energy adheres the fitment to a plastic liner through melting or to activate an adhesive. The fitment can be attached to the shell through the use of heat, welding, radio frequency induction welding, glue, flanges, interlocking connections, friction, snaps, locks, clips, rails, mechanical deformation, or any other mechanism known to one skilled in the art.

In some embodiments, the container may comprise a lid. A lid may be formed from a polymer-based material. The cap or lid or fitment can be formed of any material, such as a polymer, such as LDPE, HDPE, PET, PS, PP or biopolymer. A type of polymer can comprise polyethylene terephthalate (PET), high-density polyethylene (HDPE), polyvinyl chloride (PVC), low density polyethylene (LDPE), polypropylene (PP), polystyrene (PS), and other polymers. The polymer can be an FDA-approved plastic. The recycling groups can comprise plastic identification codes 1, 2, 3, 4, 5, 6, and 7. The polymer can be a post consumer recycled (PCR) version of the described polymers or a blend of PCR and virgin material. A recycling group can comprise a set of plastic or polymer types that can be recycled together using a recycling process that does not require separation of the plastic or polymer types prior to the recycling process.

The container shell can comprise any structural body that provides an enclosure. FIG. 8 shows the container in a cylindrical shape, however, the shape should not be limited to cylinder or symmetrical profile. The structure of the container may or may not be geometrically symmetric. The wall of the container may be of any configuration such that the contour of the wall may be straight, curve or any other profile. In some embodiments, the provided internal inter-connecting features may be formed along a straight edge, curve edge or a combination thereof.

In some embodiments, the container shell comprises a fiber or pulp-molded body. The fiber and pulp-molded body can be a clam shell, a two-piece shell, a multi-piece shell, or a combination thereof. The clam shell can be a fiber or pulp-molded body with a hinge that can be located on any side of the clam shell and a plurality of internal inter-connecting features included on the opening side for a closure of the body. The two-piece shell can comprise two fiber or pulp-molded body pieces that have internal inter-connecting features for securing the pieces to each other. The two-piece shell can be a two-part assembly of two halves of the body. However, the two pieces need not be equivalent in size. For instance, one piece can be of greater portion of the body structure than the other piece. The two-piece shell can be joined with each other along any direction on any surface. For example, the two-piece shell can be a top half and a bottom half that are joining each other not along a side parallel to the longitude axis of the container. Once the two pieces are joined, the inter-connecting tabs may be disposed in an internal region to the container resulting in a smooth connecting seam on the outer surface. A multi-piece shell can comprise two-piece fiber or pulp-molded body piece combined with a cap or bottom for securing the multi-piece shell in a closed form, or three-piece fiber or pulp-molded body piece. Pieces of the container shell can be assembled together via the provided inter-connecting features only, or a combination of the inter-connecting features and any other means known to those skilled in the arts. Heat shrink film can be used to secure the neck are for retaining the fitment and stopping undesired rotation of the fitment (e.g. 619 in FIG. 6). Heat shrink material can be used as a band or a cup at the bottom of the container to add additional retention capability to increase the drop performance of the container. Adhesive could be added to the select areas or tab to improve the structural performance. Tape could be applied to assist in improving the resistance to separation of the shells that the interlock tabs provide.

Figure 9:
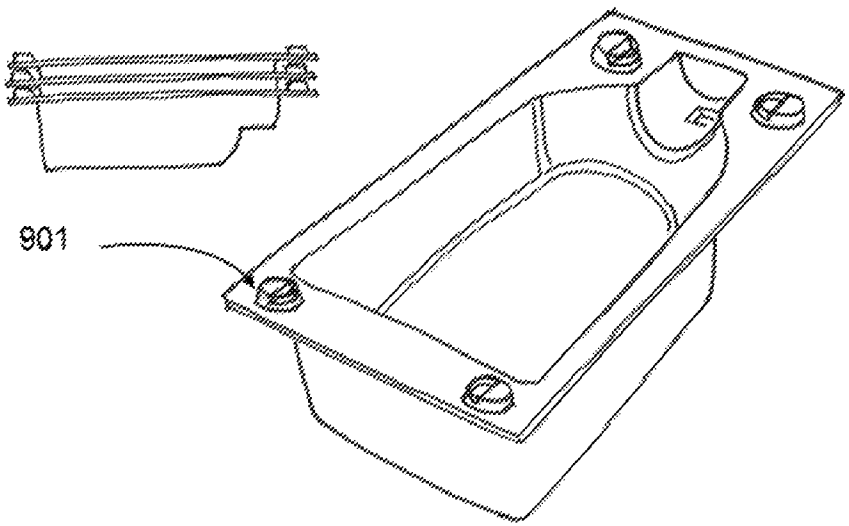
FIG. 9 shows stackable container pieces or parts with interlock features, in accordance with some embodiments.

FIG. 9 shows stackable container pieces or parts with interlock features, in accordance with some embodiments. The stackable container pieces or parts may be pulp-molded products to be moved to the point of assembly or the point for manufacturing inter-connecting features. In some embodiments, the container pieces or parts may be stackable. In some instances it is desirable for an even and consistent stacking space between shells. A first part of the container may be stacked on a second part. Any number of container parts or pieces may be stacked on top of one another. The shaped feature in the container parts or pieces may prevent the stacked parts from moving laterally relative to another. In another embodiment the stacking features limit how far the stacked shells nest into each other. Features for this can be called stacking lugs 901 and can be molded into the shell. These stacking lugs are visible such as 621 in FIG. 6. In another embodiment addition pulp can be molded to the shell with features that help to control stacking or other handling features. In a finishing operation these additional features, such as stacking lugs, can be removed.

During assembly, two or more joining edges that include the internal inter-connecting features may or may not be engaged concurrently. For example, inter-connecting tabs on an edge of a shell piece may be inserted through the complimentary inter-connecting slits on an edge of another shell piece; subsequently engagement of inter-connecting features on another side may be performed. Alternatively, inter-connecting slits/slots from two or more edges of a piece can be manipulated to have an engaging direction for receiving the mating inter-connecting tabs concurrently. After the inter-connecting tabs enter through the mating inter-connecting slits/slots from an external region to the container, the locked tabs may be disposed in an internal region to the container without creating permanent crease or deformation.

The plurality of inter-connecting features may provide a strong securing mean for the multiple container parts mechanically bonding together. Once the container is assembled, the one or more shell parts may be in a fixed configuration and not move relative to each other. The plurality of assembled inter-connecting features may be configured to effectively prevent substantial relative motion between adjoining parts in any direction, such as translational movement or rotational movement. In some embodiments, two connected pieces may be permitted to have a relative rotational movement about an axis substantially parallel to a contacting edge. The flexibility of adjusting rotational angles about the axis may allow the inter-connecting tabs transit from an engagement configuration to a locked configuration. Once the inter-connecting tabs along one side of the container shell are in the locked configuration, the movement about the contacting edge can be restricted by connection of the other side of the container part. Accordingly, once the assembly of the contain shell is completed, the inter-connecting features can ensure a tight locking configuration and provide a solid feel at the inter-connecting areas.

In some embodiments, the inter-connecting features can be formed along an entire side of a shell piece or a portion of the side. For example, the inter-connecting features can be formed only on the lower half of the edge while the other half of the edge may be connected via other connecting means. It should be noted that various combinations of connecting means can be used for connecting multiple shell pieces, even on a single side. For instance, a portion of the side can be connected using adhesion and another portion can be connected using the provided inter-connecting structure. In some embodiments, the container shell may use different connection means on different sides, portions and/or areas of the container. In another instance, other attachment means such as heat sealing, adhesive or non-adhesive tape, sealing wax or mechanical connections such as locks, fasteners and snaps-locks can be used in addition to the provided inter-connecting method to provide a stronger sealing or connection. However, when no glues or additional materials included in the container shell, the described inter-connecting method and system provides a highly recyclable single material container which can be completely compostable and/or recyclable.

The containers may be suitable for containing various types of materials. For example, the containers may be suited for holding liquids, granules, solids, or semi-solids. The containers may hold beverages, food, powders, pellets, pills, detergent, or other materials.

The material used for forming the container shell need not be food-grade. In some embodiments, additional features such as a liquid-holding vessel can be included for holding liquid, or any feature that is made of food-grade material can be included inside the container shell. Accordingly, the outer shell can be separated to be recycled and the other features made of different materials can be disposed or recycled as applicable. The container shell can comprise biodegradable materials, such as molded fiber or pulp or paper. For example, the container shell may comprise 100% post-consumer fiber or pulp feedstock. In another example, the shell may comprise 100% recycled corrugated fiberboard and newspaper. The container shell or other materials described herein can include virgin fiber or pulp stock. The container shell can comprise type-2 molded fiber, type-2A thermoformed fiber, type-3 thermoformed fiber, type-4 thermoformed fiber, molded fiber, X-RAY formed fiber, infrared formed fiber, microwave formed fiber, vacuum formed fiber, structural fiber, sheet stock, mandrel stock, recycled plastic, thermoformed plastic, sheet plastic, or any other structural material. Any of the materials that may be used to form the container shell may be used in any of the embodiments described herein. Any discussion of pulp may also apply to any of the materials (e.g., fiber molding, natural fibers, biodegradable or compostable materials, or formed sheet material or films) that may be used to form a container shell. Formulations can be adjusted to improve desired performance aspects including, but not limited to, strength when wet, tensile strength, compression strength, moisture resistance, olfactory control additives, oxygen or $CO_2$ or other gaseous permeability. For example, a thermoformed fiber material may provide strength, durability and flexibility that may allow the tab features deform to certain extent during engagement with reduced creasing. The connecting method as provided may allow a container to be completely recyclable as no glues or other non-recyclable materials are required for assembling the container.

As thickness of the material may be adjusted for best performance (e.g., required material strength), design of the inter-connecting features (e.g., tab features and slit/slot features) in size, arrangement, pitch, spacing and shape may be adjusted accordingly to allow for a smooth outer surface, a forceless insertion during engagement process, a tight fit after engagement and the like.

The container shell may be formed from two, three or more types of pulp molded parts. The container shell made of multiple parts may comprise parts formed from any suitable materials described elsewhere herein. The shell parts may or may not be made of the same material. Materials may be combined for the purpose of cost reduction, increasing structural performance, increasing impact attenuation, and for providing areas of higher tolerance as well as areas of lower tolerance in the same container such that, for example, the high tolerance areas may be specifically located for the inter-connecting features. The container shell may have been assembled for desired structural performance and for allowing for disassembly to facilitate recycling or composting of the unassembled materials.

The container shell can be formed in a dual or multiple wall configuration to allow for heavy load containment and/or dispensing. One or more shell parts may be formed of two or more layers, enabling a container design with a higher load rating. Alternatively, a container may be assembled as a single wall container in order to reduce material consumption. In some embodiments, the inter-connecting features may be provided to allow for conversion of a container to a container suitable for more rugged performance (greater overall rigidity) through the addition of one or more parts of wall. For example, the inter-connecting features may be provided in areas where the largest mechanical stress is exerted such that extra wall(s) may be added by connecting through the inter-connecting features on the inside or outside surface or the container shell. Any description of a dual wall configuration herein may also apply to multiple walls.

Location of the inter-connecting slot/slit features may also determine the double wall configuration. As described previously, distance from the location of the slot/slit features to the edge determines an overlapping area. Accordingly, increasing the space from the inter-connecting slit/slot features to the edge may increase the double wall area. The one or more double wall areas may be located anywhere on the container shell, including the bottom, top and sides of the container. Alternatively, the entire container may comprise double-walled areas. The double walled areas may or may not be connected and the connection could be through inter-connecting or other means of connection described herein.

Figure 10:
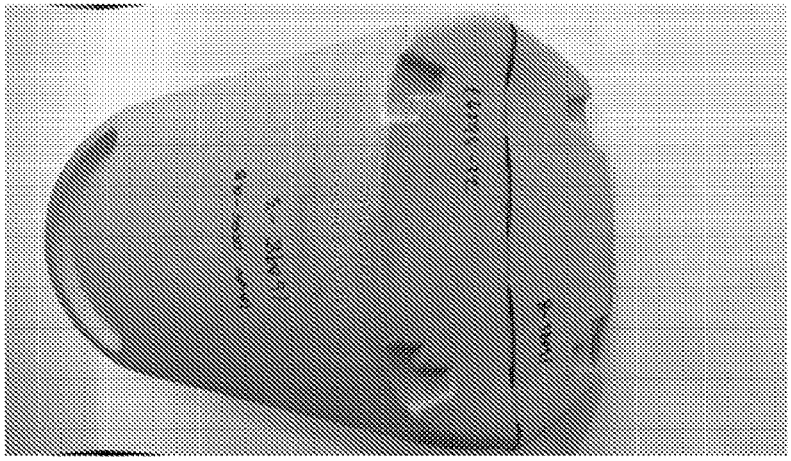
FIG. 10 provides an example of a pulp-molded container shell comprising multiple parts connected by inter-connecting structures, in accordance with some embodiments.
Figure 10:
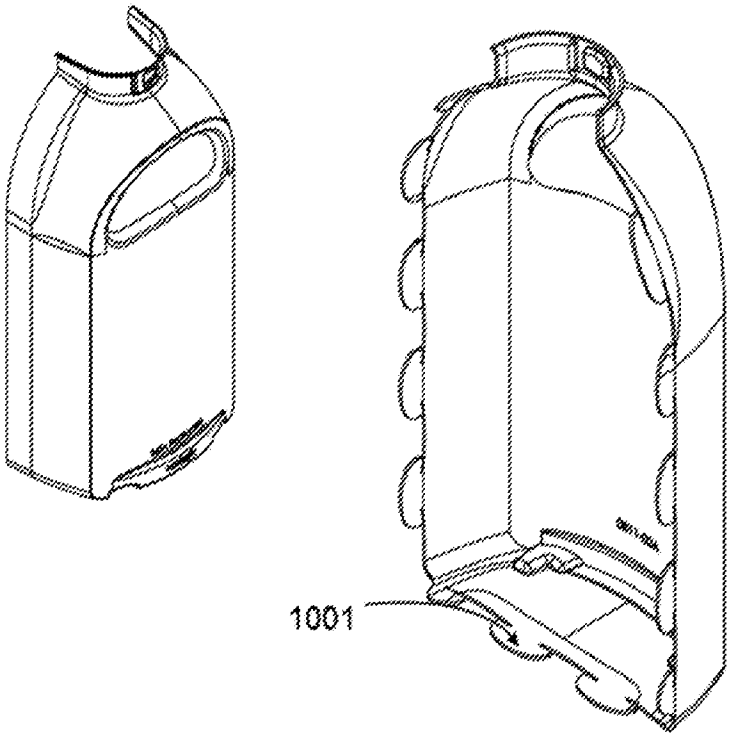

The internal inter-connecting features may allow for a smooth outer surface to be formed from two pulp-molded parts, pieces, or halves (e.g., the assembled container 805 in FIG. 8). In some embodiments, the internal inter-connecting features may also allow for an even or flat surface to be formed to the external of the container. For example, the inter-connecting features can be located at the bottom of the container shell such that the bottom surface may be flat or sit flat with the absence of any protrusion features (e.g. 1001 in FIG. 10). The flat bottom can be further strengthened by an overlapping area (e.g., double layer configuration) induced by the inter-connecting structure to improve loading capacity as well as structural integrity.

The plurality of inter-connecting features can help distribute loading forces such that the force applied to each pair of inter-connecting features is reduced and splitting two pieces apart at the seams under the load may be prevented.

As described above, the pulp-molded container shells may comprise a plurality of inter-connecting features for connecting one or more pieces of the container shells together. The container shells with the inter-connecting features can be formed in various ways. Formation of the inter-connecting features and the body of the container shells may or may not be simultaneous. In some embodiments, the inter-connecting features may be formed after the container shells are molded. For instance, the inter-connecting features may be formed by removing materials of the molded container shells. Alternatively, the inter-connecting features may be formed concurrently with molding the container shell. For instance, the associated inter-connecting features are included in the mold used in the molding process. In some cases, some of the inter-connecting features or a portion of an inter-connecting feature may be formed by pulp molding process whereas others are formed after the pulp molding process. For instance, some low tolerance edges of an inter-connecting feature may be formed by the molding manufacturing process and high tolerance edges of an inter-connecting feature may be formed by cutting process or vice versa.

Figure 11A:
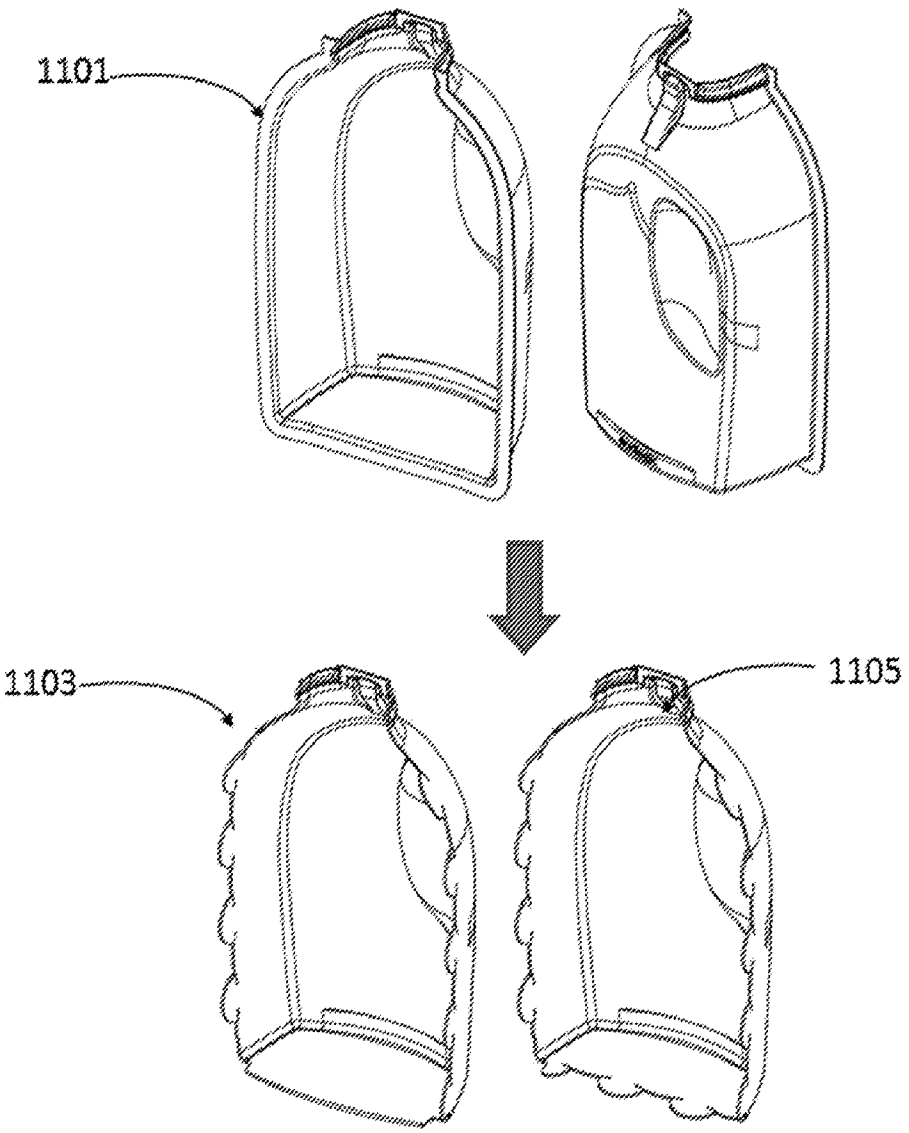
FIG. 11A shows an example of pulp-molded container shells comprising inter-connecting features at different stages of manufacturing process.

FIG. 11A shows an example of pulp-molded container shells comprising inter-connecting features at different stages of a manufacturing process. In some instances, the inter-connecting features may be formed after the container shells are pulp molded. As shown in FIG. 11A, container shells 1101 may be formed after pulp-molding process. In some cases, inter-connecting features may not be formed during the pulp-molding process. In some instances, features such as long side walls and flanges may be formed with the molded container shells during the pulp-molding process. These features may or may not be removed in further manufacturing steps. This may provide flexibility of connecting container shells. For example, the pulp molded container shells 1101 may be provided with at least two types of connecting features such as the flanges and inter-connecting features (e.g., tabs and slots). When flanges are desired, the flanges formed with pulp molded container shells may be kept to connect the shell parts as described elsewhere herein. However, if inter-connecting features are desired at the sides whereby the flanges are formed, the flanges may be removed and inter-connecting features may be formed in place. The removal of molded material may be purposeful and detailed. Various types of manufacturing processes may be involved in the pulp-molding process such as thick-walled process, transfer molding, thermoformed fiber molding thermoformed polymer sheet molding, processed pulp process, injection molding, vacuum forming, stamping or deep drawing. In some cases, when a high quality thin wall container is desired, thermoforming molding process may be performed. The pulp-molding process may or may not include secondary process or steps to obtain smooth surfaces of the interior and exterior of the container shells.

Figure 11B:
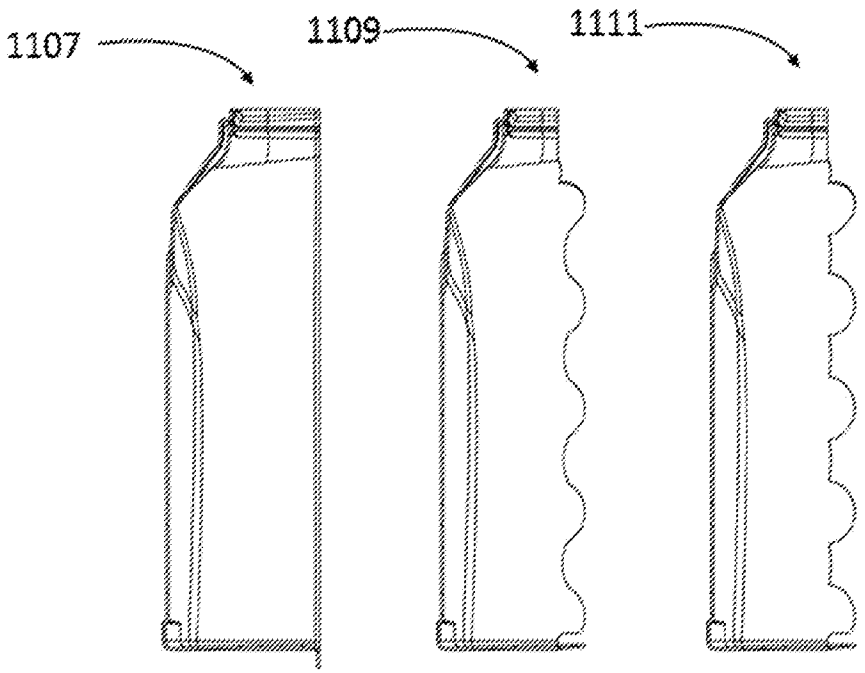
FIG. 11B illustrates examples of container shells with or without inter-connecting features formed during molding process.

In some cases, the inter-connecting features are not formed during the molding process. In some cases, some inter-connecting features or a part of an inter-connecting feature may be formed during the molding process. FIG. 11B illustrates examples of container shells with or without inter-connecting features formed during molding process. As mentioned above, the inter-connecting features may not be formed during molding process. For example, a container shell 1107 having substantially straight edges may be formed by pulp molding. In some cases, a portion or part of an inter-connecting feature may be formed by the molding process. For example, as shown in the container shell 1109, a leading edge of the tab features may be formed during molding process. In some cases, some low tolerance features may be formed by the pulp-molding process and high tolerance features may be formed later by other manufacturing process such as cutting. For example, as shown in the container shell 1111, the leading edges and side edges of a tab portion may be formed by the molding process and the back edges or the slot/slit features may be formed by cutting.

Referring back to FIG. 11A, operations may be applied to the pulp molded container shells 1101 to further form the inter-connecting features 1103, 1105. As described elsewhere herein, the inter-connecting features may be formed in any location and along any sides of the pulp-molded container shells. The provided manufacturing processes may provide flexibility in determining the location of inter-connecting features. Container shells with inter-connecting features formed on different locations can be manufactured from the same molded container shells. For instance, the shell part 1103 may be cut or trimmed to have inter-connecting features formed on the side walls and shoulders of the shell part and an overlap flap arrangement is formed to remain for the bottom of the shell. A different shell part 1105 may have inter-connecting features on the bottom in addition to the side walls and shoulders by a further cutting or trimming process.

A plurality of inter-connecting features may be formed on the pulp-molded container shells. The inter-connecting features may be formed by removing material from the pulp-molded container shells with a process such as cutting. Various shapes and dimension of the inter-connecting features can be formed by a cutting process. The various different shapes and dimensions of the inter-connecting features may be designed to effect an assembly process or performance of an assembled container. For instance, the shapes and dimensions of the inter-connecting features may be selected such that a direction of the engagement movement between two shell parts may be determined or a tightness of the locked inter-connecting features may be determined.

Figure 12:
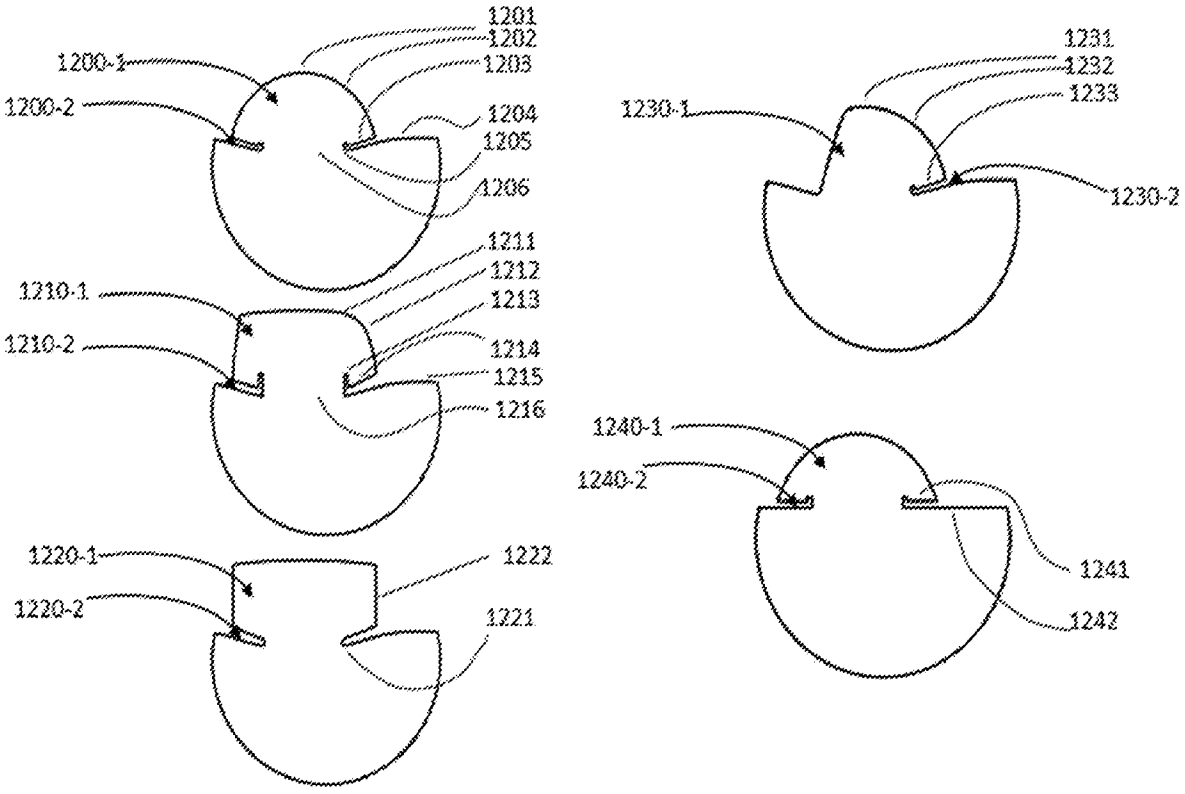
FIG. 12 shows examples of tab and slots/slits features can be formed by a cutting process.

FIG. 12 shows examples of tab and slots/slits features that may be formed by a cutting process. As described elsewhere herein, the inter-connecting features may comprise at least a tab portion 1200-1, 1210-1, 1220-1, 1230-1, 1240-1 and a slot/slit portion 1200-2, 1210-2, 1220-2, 1230-2. The tab portion and slot/slit portion may include a variety of shapes or configuration. For example, the tab portion may comprise a leading edge 1201, 1211, 1231, side edges 1202, 1212, 1222, 1232, back edges 1203, 1214, 1233, 1241, and a root portion 1206, 1216. The back edges may also define part of the slot or slit portion. The slot or slit portion may be defined by the back edges of tab portion, a cut edge 1204, 1215, 1233, 1242 and a return cut feature 1205, 1213, 1221.

As illustrated in FIG. 12, the leading edge of the tab portion may have a variety of curvatures and may comprise various linear shapes. For instance, the leading edge may be round 1201 or curvilinear 1211. The leading edge may be symmetrical 1201 or asymmetrical 1211, 1231. Similarly, the side edges of the tab portion may comprise any linear shape such as curved 1202 or straight line 1222. The side edges on each side of the tab portion may be symmetrical 1202, 1222 or asymmetrical 1212, 1232. In some instances, the leading edge and side edges may collectively affect a direction of the engagement movement between two shell parts. For example, an asymmetrical side edges may allow the tab to be entered the mating slot in an oblique direction.

In some instances, the back edges 1241 may be parallel to the cut edges of the slot or slit portion 1242. In some instances, the back edges 1203, 1233 may be parallel to a portion of the cut edge 1204. In some instances, the back edge 1214 may be not parallel to the cut edge 1215. For instance, a tapered slot shape may be defined by the non-parallel edges 1214, 1215. In some instances, the back edge on one side of the tab portion is parallel to the cut edge whereas the other side is not. The back edges may be on both sides of the tab portion. Alternatively, the back edge may be formed on a single side of the tab portion 1233. In some instances, the back edges and/or cut edges may affect the tightness of the locked inter-connecting features. For example, as described elsewhere herein, an overlapping portion defined by the back edges and the cut edges may be varied in dimension to improve the strength of the engagement.

The slot or slit portion may comprise a return cut feature 1205, 1213, 1221. In some cases, the return cut feature 1205, 1213 may comprise a slot to separate the back edge from the root portion thus allowing the back edge 1203, 1214 to move relative to the root portion 1206, 1216 to certain extent. This may provide flexibility during engagement process. Alternatively, the return cut feature 1221 may not separate the back edge and the root portion thus a high structural stability may be provided.

As described previously, the inter-connecting features can be formed in a curved surface as an extending portion of a shell part. The inter-connecting features need not be evenly spaced. The spacing or pitch of the inter-connecting features may be defined by the cutting process. Such inter-connecting features may be formed by various cutting methods including, but not limited to, knife, die cut, steel rule die, perforating tools, water jet, abrasion cutter, laser cutter, hot wire, abrasion blasting, plasma cutting, stamping, or CNC machining. Similarity, other features such as holes or windows can be formed using such methods. In some cases, the inter-connecting features may be formed using a single method. In some cases, the inter-connecting features may be formed using two or more methods. The cutting process may be a single-step process. Alternatively, the cutting process may be a multiple-step process.

In some instances, different cutting methods may be selected based on the amount of material to be removed, the shape of the features, or the tolerance requirement or precision requirement of the feature. For instance, formation of a slit feature may not require removal of material and slit forming knife may be used for cutting the slit. In another instance, when a slot feature that requires more material to be removed, streaming cutters such as laser, a thicker knife, a punch (like a knife, but thicker and more blunt) or water jet may be used to form the slot feature.

Figure 13:
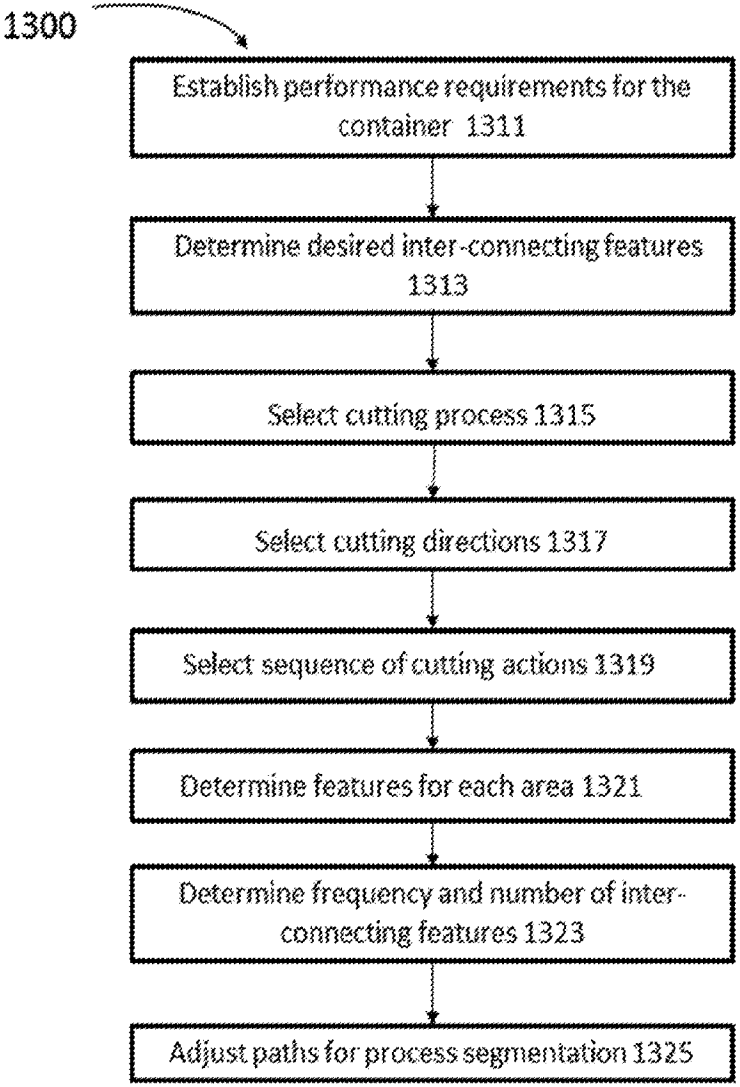
FIG. 13 illustrates an exemplary process of determining a cutting path.
Figure 13:
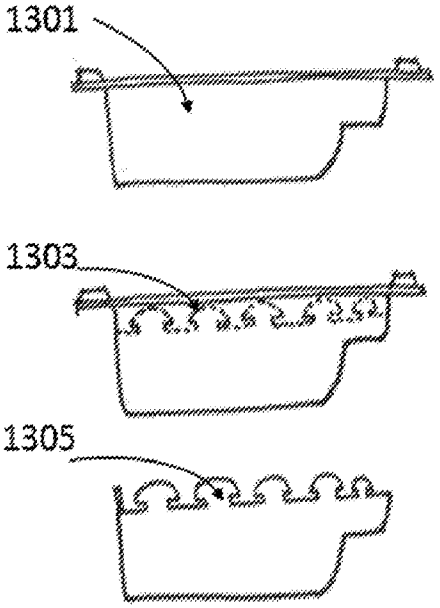

In some embodiments, a cutting path may be determined prior to a cutting operation. The cutting path may define the edges or shapes of the features to be formed on the pulp-molded container shell. The cutting path may be defined according to a working edge of the inter-connecting features. The working edge may include the edges of the tab and slots features such as leading edges, side edges, and back edges of a tab portion, cut edge, or return cut feature of a slot or slit portion. In some cases, a cutting path may follow the working edges. Alternatively, a cutting path may not overlap with all of the working edges. FIG. 13 illustrates an exemplary process of determining a cutting path 1300. The cutting path 1303 may be determined relative to a pulp-molded container 1301. The cutting path may define the shapes or edges of features 1305 to be formed on the pulp-molded container shell. One or more factors may be considered for determining the cutting path. For instance, the cutting path may be determined based on the dimension and shape of the features to be formed, frequency of the features, area in which the features to be formed, the specific cutting tools, or dimensionality of the materials to be removed (e.g., thickness) and so on. The cutting path may be generated automatically or semi-automatically. In some cases, the cutting path may require one or more inputs such as the desired shape or dimension of inter-connecting features, frequency of the features, cutting directions, cutting actions and the like. In some cases, one or more of the steps in the process 1300 may be generated by the manufacturing machine automatically. One or more of the parameters or input may be provided by a user every time when a cutting path is determined. In some instances, one or more of the parameters or inputs may be selected from a plurality of parameters pre-stored in a memory. In some instances, one or more of the parameters or inputs may be automatically generated by a computer program.

The flow chart of the process for determining the cutting path 1300 is for illustrative purpose only. It should be noted that any of the steps may be skipped or the order may be changed according to the specific tool used for cutting. In the illustrated example, the process may begin with establishing performance requirements for the container 1311. The performance requirements may be related to one or more performance criteria, such as drop height, top loading, shipping vibration, and various others. The performance requirements may be input provided by a user. The performance requirements may be selected from a plurality of pre-stored performance requirements by a user. Next, the process may proceed with determining desired inter-connecting features 1313. At this step, one or more parameters or requirements related to the inter-connecting features may be determined, such as length and width of the tabs or slots, shapes of the tabs or slots, the working edges of the tab or the slot/slit features, symmetricity of the tab features, symmetricity or opposing tabs and the like. In some instances, the desired inter-connecting features determined at this step may be associated with a single inter-connecting feature. The desired inter-connecting features may be an input provided by a user. The desired inter-connecting features may be selected from a plurality of pre-stored inter-connecting features by a user.

Next, a cutting process may be selected 1315. This may include selecting the tools and method for cutting. The cutting process may be selected from a variety of methods, including but not limited to, knife, die cut, steel rule die, perforating tools, water jet, abrasion cutter, laser cutter, hot wire, abrasion blasting, plasma cutting, stamping, punched, die cut or CNC machining. The cutting process may be an input provided by a user. The cutting process may be selected from a plurality of pre-stored cutting processes by a user. The cutting process could be controlled by following a predetermined guide or a template.

Figure 14A:
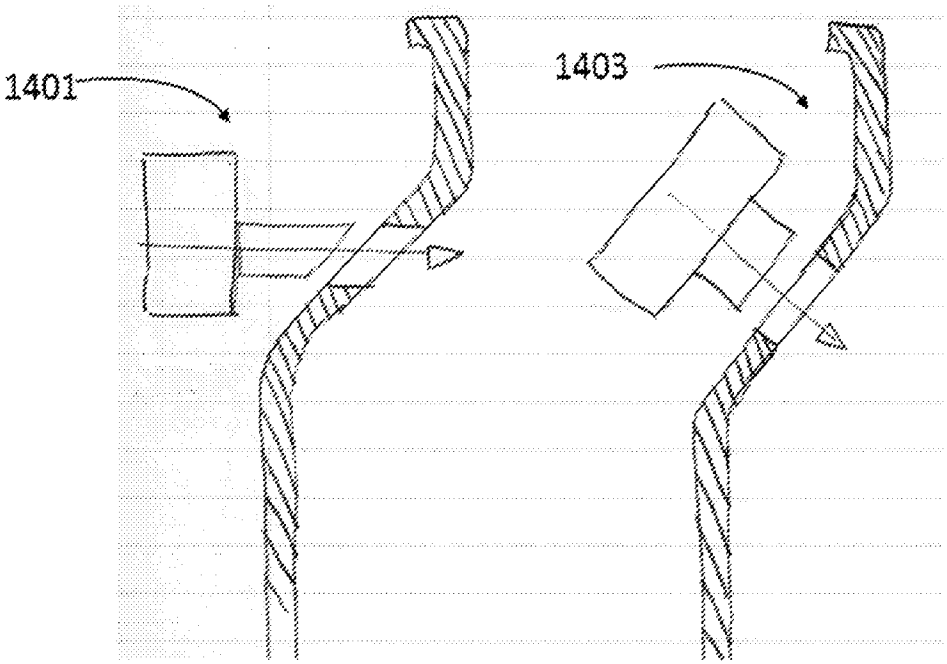
FIG. 14A and FIG. 14B show examples of different cutting directions.
Figure 14B:
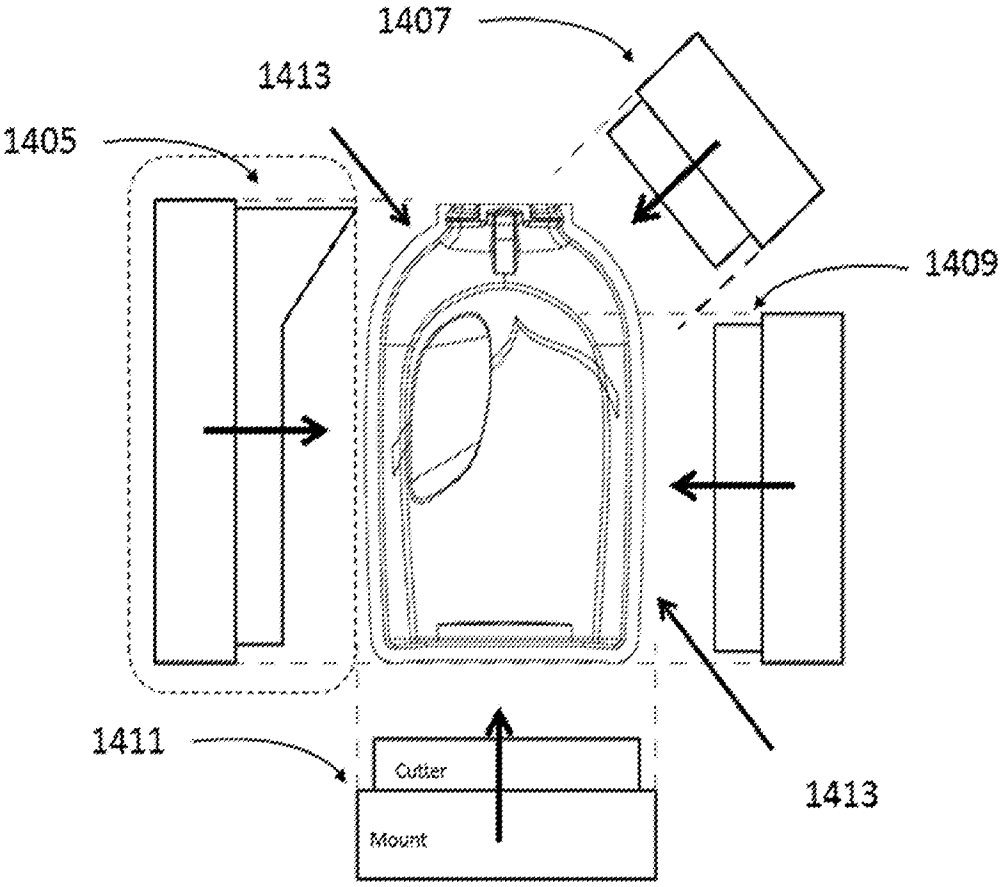

In some cases, cutting directions may be selected 1317. The cutting direction may determine the direction from which a cutter is approaching relative to the container shell or at which direction the container shell gets cut. FIGS. 14A and 14B show examples of different cutting directions. In some cases, the cutting direction may determine whether the cutting orientation of the cutter relative to the container shell is normal to the surface to be cut. When the cutting orientation of the cutter is oblique to the surface 1401, the cut may form an angled feature in the wall of the container shell. When the cutting orientation of the cutter is normal to the surface 1403, the cut may form a perpendicular feature in the wall of the container shell. In some cases, cutting direction may determine at which direction the container shell gets cut. For instance as illustrated in FIG. 14B, a single container shell may get cut from one or more directions, including but not limited to, right side 1409, right shoulder 1407, left side 1405, left shoulder 1405, or the bottom 1411. In some cases, the cutter may have a shape to accommodate a shape of the container such that a single cutter can be used to perform trimming to side with a curved profile from a single direction. For instance, the cutter 1405 may have a shape to accommodate a shoulder and side wall area such that both the shoulder and side wall can be cut by a single cutter 1450 via a single translational movement towards the container. Alternatively, the shoulder and side wall may be cut by separate cutters 1407, 1409 from different directions. In some cases, the cutters may be modular and can be arranged to have various collective shape to cut different profiles, different shells, or different shapes. This provides benefit for saving cost and increasing production flexibility. The described method and cutters may be part of an automated manufacturing system. The container shell to be cut may be mounted to a mandrel. Details about the mandrel are described with respect to FIG. 18. The cutters and cutting operations may be automatically controlled by a machine. Materials cut away during the cutting process may be removed in an automation mechanical fashion from the cutting area. For example, the materials cut off from the container shell can be removed through vacuum where there may be openings proximate to the mandrel or the cutters to draw in the cut-off material during the cutting process. The cut-off material within an area 1413 of the container shell such as at the perimeter of the shell being cut may be drawn away by the vacuum and associated opening and channels. The vacuum may be applied from various directions such as from the perimeter of the container shell or from below the mandrel.

Referring back to FIG. 13, next, a sequence of cutting actions may be selected 1319. The sequence of cutting actions may include the movement of the cutter relative to the container shell. The sequence of cutting actions may segment a cutting process into a plurality of actions. Next, features for each area of the container shell may be determined 1321. In some cases, different area of the container shell may require different inter-connecting features to be formed. For instance, the inter-connecting features formed on the bottom may not be the same as the inter-connecting features formed on the side walls. In some cases, numbers and frequency of inter-connecting features may be determined 1323. The frequency of inter-connecting features may include the spacing or pitch of a plurality of inter-connecting features of the same type or different types. The frequency of inter-connecting features may or may not be uniform in the same area or along the same side, and the pitch or size of the inter-connecting features may vary according to the curvature or contour of the container shell. In some cases, the number of inter-connecting features of the same types may be determined. In some cases, the number of inter-connecting features in the same area of the container shell may be determined. In some cases, when one of the number and frequency is determined, the other one may be automatically determined accordingly to fit the inter-connecting features along a pre-determined side. In some cases, the cutting path may be adjusted for segmentation of the cutting process 1325.

Figure 15:
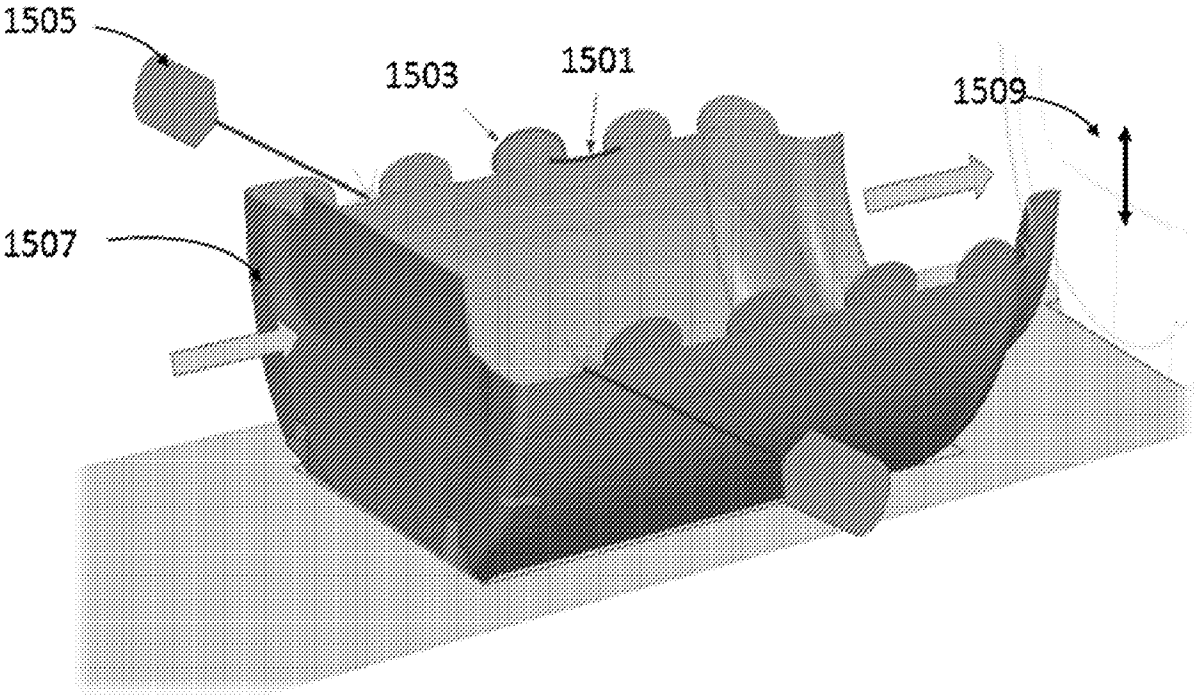
FIG. 15 shows an example of laser cutting.
Figure 16:
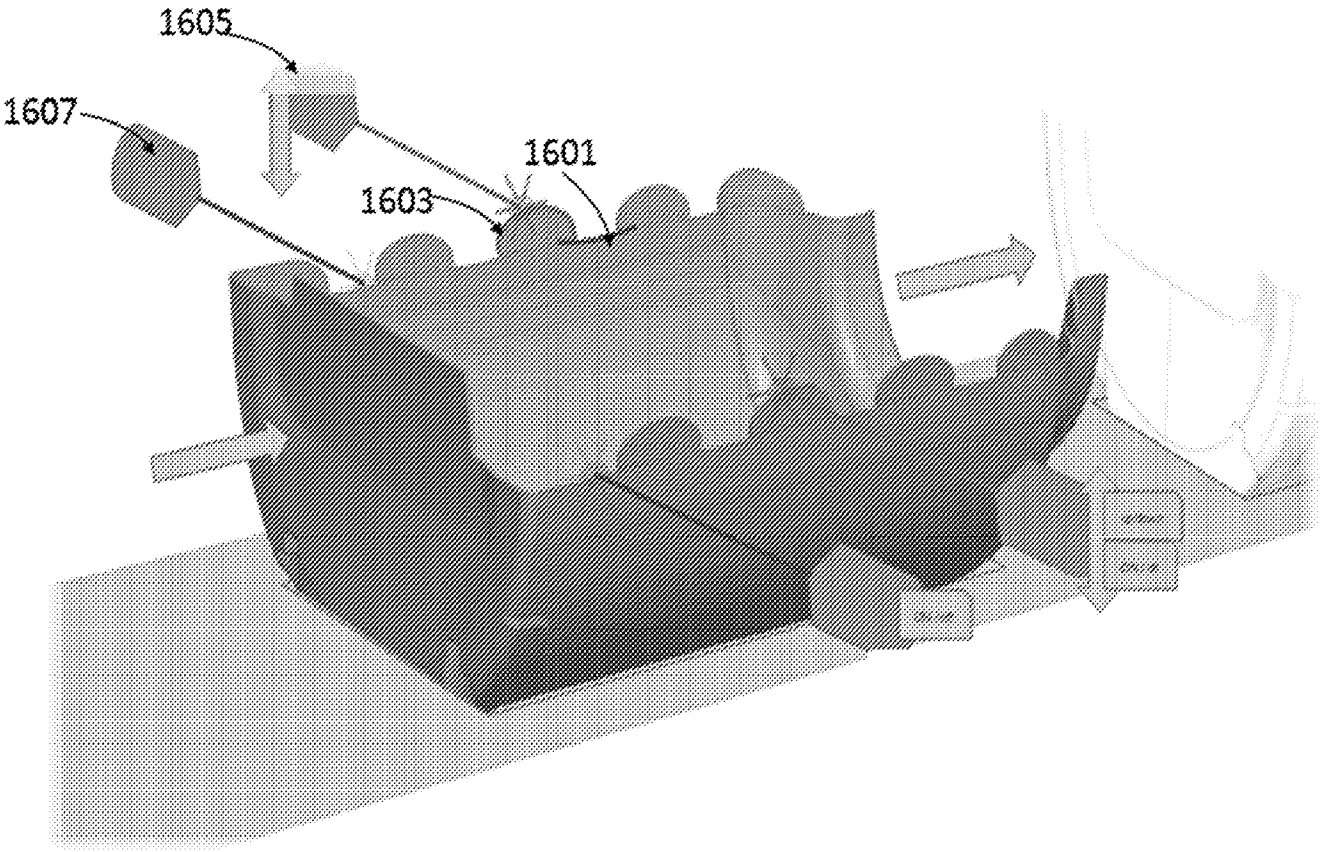
FIG. 16 shows an example of using laser cutting to form the inter-connecting features.
Figure 17:
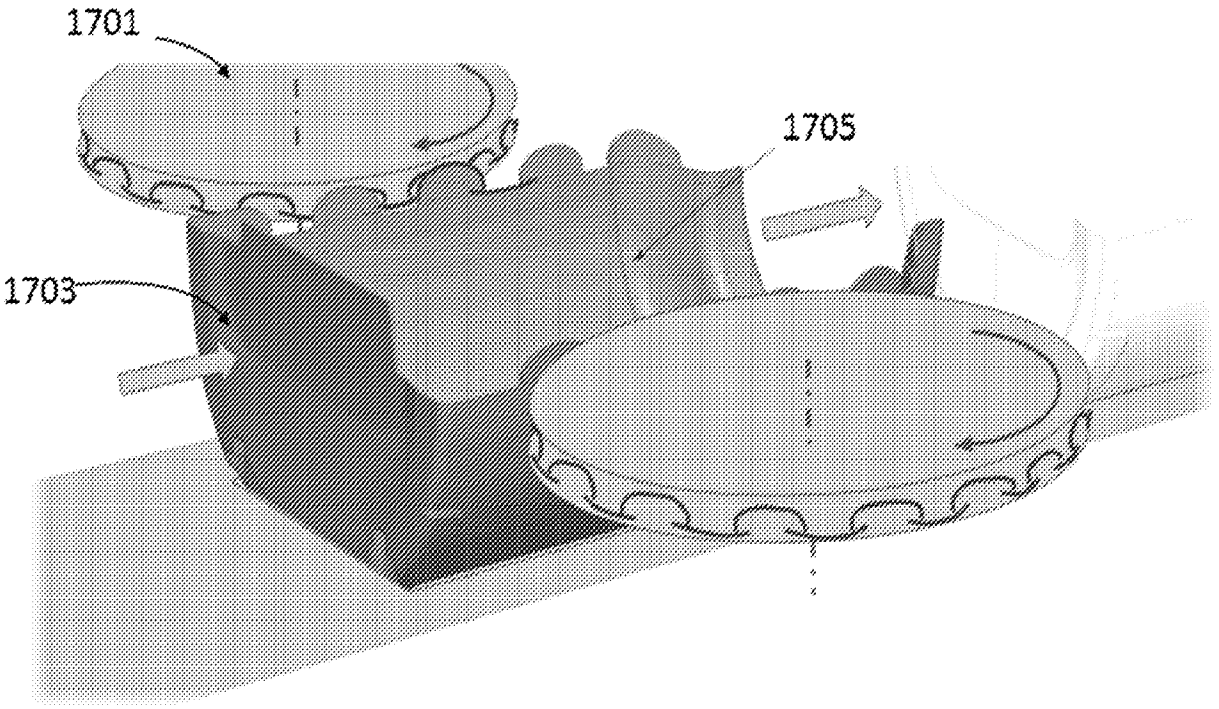
FIG. 17 shows an example of a cutting method.

Different cutting methods may be used individually or collectively to form the various features. In some cases, the various features may be formed by a combination of a cutting process and a non-cutting process. In some cases, the inter-connecting features may be formed solely by a cutting process, a molding process or a combination of both. FIGS. 15-17 provide examples of different cutting processes can be used for forming the inter-connecting features. FIG. 15 shows an example of laser cutting. As illustrate in FIG. 15, a portion of the inter-connecting features or working edges 1503 may be formed by the molding process and the rest of the working edges 1501 may be formed by laser cutting. In some cases, the portion of working edges formed by the molding process may be low tolerance edges such as the leading edge and leading side edge of the tab portion. In some instances, the portion of working edges that are low tolerance may be formed by other manufacturing process other than the molding process.

The laser cutter 1505 may move relative to the molded container shell 1507. In some instances, the laser cutter moves while the container shell is static. In some cases, the container shell is moving while the laser cutter is fixed. For example, the laser cutter may be fixed in space whereas the molded container shell is passing through the laser cutter on a conveyor as illustrated in the figure. In this way, a straight linear slit or back edge of the tab portion may be formed. In others cases, both the container shell and the laser cutter are configured to move. For example, while the container shell is moving pass the laser cutter, the laser cutter may be configured to move in the vertical direction 1509 such that a curved linear cut may be formed. The relative movement between the laser cutter and the container shell may be a single pass or in one direction. Alternatively, the relative movement between the laser cutter and the container shell may be multiple passes or in two or more directions.

FIG. 16 shows another example of using laser cutting to form the inter-connecting features. In some cases, a portion of the working edges or an inter-connecting feature can be formed by an additional laser cutter. Two or more laser cutters may coordinate with each other to operate on different edges of inter-connecting features. In the illustrated example, the leading edge and leading sides ledges 1605 may be formed by a first laser cutter 1605 and the back edge or slit 1601 may be formed by a second laser cutter 1607. The first laser cutter 1605 may be configured to move in the vertical direction such as a curved profile of the tab portion can be formed. The second laser cutter 1607 may be fixed and a substantially linear and straight cutting edge may be formed. The speed and moving path of the first and the second laser cutters may be designed such that while the container shell is moving pass the operation stage, the inter-connecting features can be formed efficiently.

FIG. 17 shows another example of a cutting method. In some cases, die cutting may be used to form the inter-connecting features. As illustrated in FIG. 17, rotary die cutting may be used. In some instances, a rotatory die cutter may be corresponding to a side of the container shell 1703. In the case when both sides of the container shell are to be cut, each side may be cut by a rotatory die cutter 1701. In some cases, the container shell may need to be retained in place 1705 in order to counteract the cutting force exerted by the die cutter.

Figure 18:
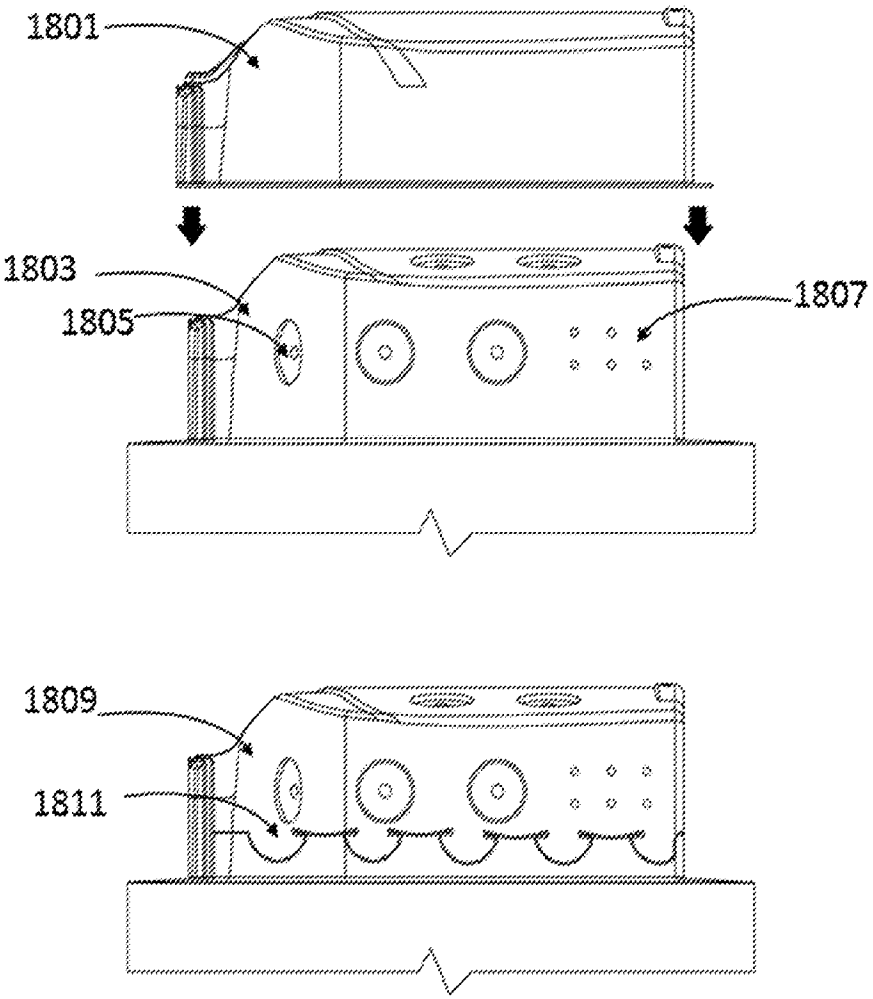
FIG. 18 shows an example of retaining a molded container shell using a mandrel.

The container shell may be retained in place to ensure the relative movement between the cutter and the container shell is following a designed cutting path. The container shell may be registered or aligned with a cutting machine or cutting system such that the relative position between the container shell and the cutter is controlled. Various methods may be used to retain the container shell during cutting process such as a mandrel or a depressed cavity. FIG. 18 shows an example of retaining a molded container shell 1801 using a mandrel 1803, 1809. In some cases, the mandrel 1803 may comprise a shape similar to the molded container shell. The mandrel may have a dimensionality substantially the same or slightly offset from the molded container 1801 shell such that the container shell can be accepted on the mandrel. The mandrel may have the same shape and dimensionality as the interior surface of the container shell such that the container shell may be supported by the mandrel from inside.

The mandrel 1803, 1809 may comprise features for holding the container shell in place. For instance, the mandrel may comprise one or more vacuum suction cups 1805 or vacuum holes 1807. Any number of vacuum suction cups or vacuum holes may be provided. For example, at least one, two, three, four, five, six, seven, ten, twenty vacuum suctions cups or vacuum holes may be provided. The vacuum suction cups or vacuum holes may be placed in varied locations of the mandrel such as close to the sides where the features to be formed or in a region that is away from the sides. Other features such as mechanical clamping, solenoids and magnets can also be used for holding the container shell in place.

In some cases, the mandrel 1811 may comprise features 1811 having similar shape of the inter-connecting features to be formed. Such features may allow cutters such as die cutter, steel rule die, profiled punch to translate toward the mandrel loaded with a container shell, cut the container shell and then enter the mandrel through an accommodative feature such as feature 1811. In another instance, a knife, travelling cutter, laser or water jet could move along the features 1811 to form the corresponding inter-connecting features on the container shell and the feature 1811 allows the mandrel to resist the cutting action and force. Alternatively, the mandrel 1803 may not have such as similar shaped features. In this case, the mandrel for holding container shell in place may be resistive or accommodative to certain types of cutters such as laser cutter or water jet.

Other methods can also be used for holding the molded container shell in place during a cutting process. For example, a cavity may be used to receive the container shell. The interior of the cavity may have a similar shape of the container shell. The cavity may be used to support an exterior surface of the container shell and additional support may or may not be required to support the container shell from inside. In some cases, the cavity may also comprise features such as vacuum holes or suction cups as described above for holding the container shell in place.

In some cases, the container shell may comprise features to facilitate alignment or positioning with a mandrel or a cavity. For example, the container shell may comprise protrusions, holes, dimples that can be registered with a mating feature on the mandrel or the cavity. As the relative location between the mandrel/cavity and the cutters are known, the alignment of the container shell to the mandrel/cavity may provide an accurate location control between the container shell and the cutters. In some instances, the mandrel or the cavity for registering position of the container shell may be part of a cutting system or cutting machine.

In some embodiments, transfer and handling of the container shells at different manufacturing stages may be operated automatically, semi-automatically or manually. For instance, a gripper or robotic end effector may be used to retain the container shell onto the mandrel as it is cut, place the container shell on, or remove the container shell from the mandrel, move the container shells to the point of assembly or the point for manufacturing inter-connecting features. As mentioned previously, the container shells may be stackable. Stacking features may be used to control the pitch or how far the stacked container shells nested into each other. This is beneficial for an automated robotic end effector to pick up the stacked container shell and separate it from another stacked container shell.

Figure 19:
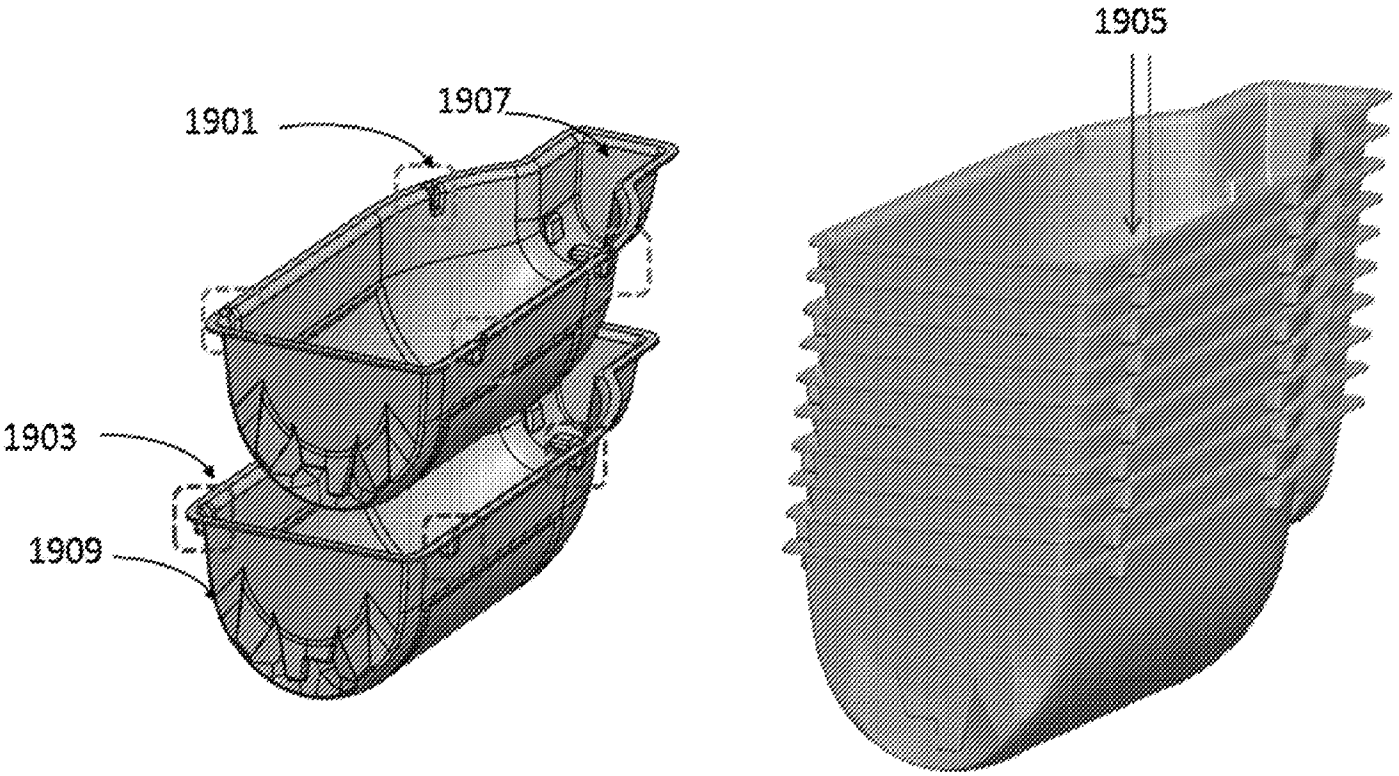
FIG. 19 shows examples of stacking lugs formed along perimeter of the container shell.
Figure 20:
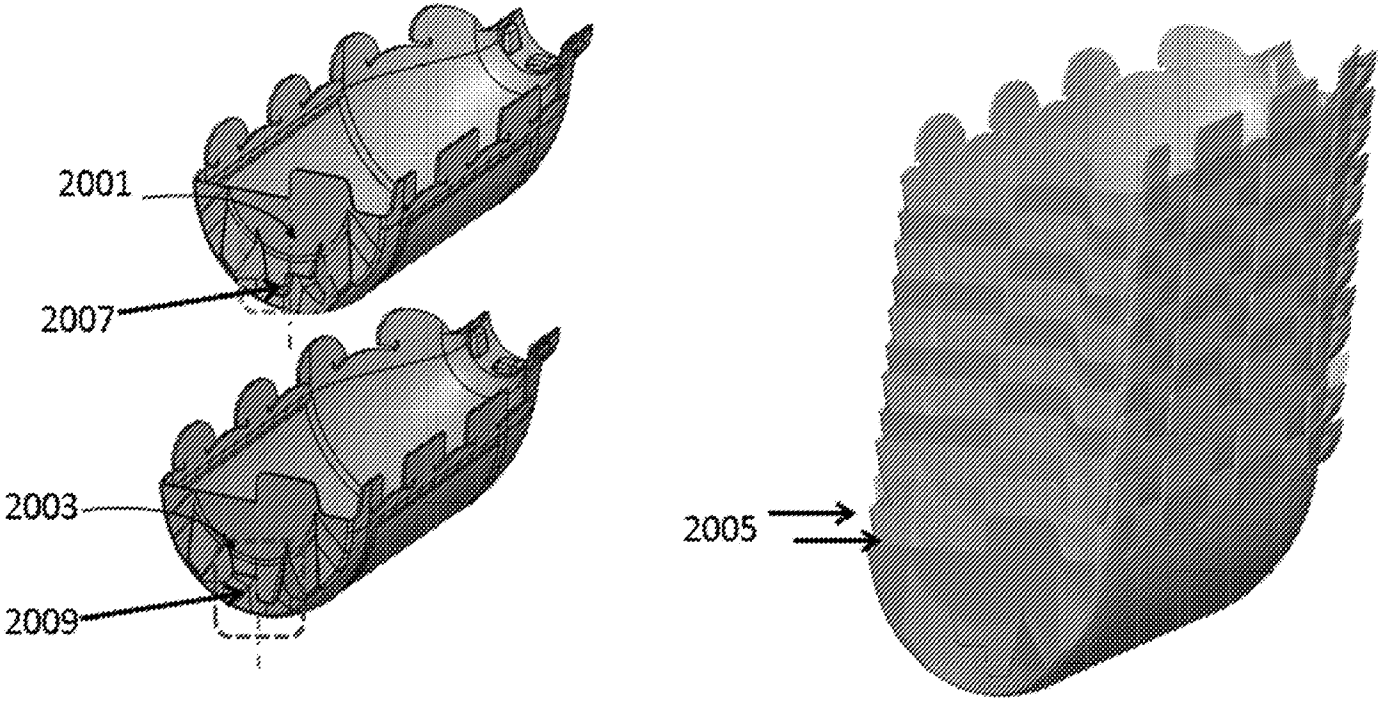
FIG. 20 shows examples of stacking lugs formed at bottom area of the container shell.

FIG. 19 and FIG. 20 show examples of stacking features. The stacking features may be stacking lugs. The stacking lugs may be formed during the pulp-molding process. In some cases, the stacking lugs or some of the stacking lugs may be removed during a cutting process by which inter-connecting features are formed. A dimension of the stacking lugs may determine a spacing between adjacent container shells that are stacked together. The stacking lugs may vary in shapes and dimensions.

The stacking features may be formed in various locations. For example, the stacking features may be formed along perimeter of a container shell and/or bottom of the container shell. As illustrated in FIG. 19, the stacking lugs 1901, 1903 may be formed along a perimeter of the container shell. The stacking lugs can be located underneath the rim such as lugs 1901, 1903 or above the rim such as the lugs shown in FIG. 6. Any number of lugs can be formed along the perimeter. For example, at least two, three, four, five, six, seven, eight, nine, ten lug features may be formed along the perimeter. The location of stacking lugs may or may not be the same across the container shells that are stacked. In some cases, the stacking lugs 1901, 1903 may be located with an offset 1905 between adjacent container shells. The arrangement of the stacking lugs on different container shells may or may not be different. For example, the arrangement of stacking lugs on container shell 1907 may be different than the arrangement of stacking lugs on container shell 1909. This may be beneficial when the container shells with different stacking lugs arrangements are stacked onto each other in an alternating fashion, the stacking lugs from one container shell may avoid the stacking lugs from the neighboring container shell allowing the stacking lugs to rest on an undisturbed perimeter flange so as to keep a spacing 1905 between adjacent container shells. A stack of container shells may have any number of different arrangements for the stacking lugs. The illustrated example shows two different arrangements, however, three, four or more different arrangements may be employed for controlling the spacing. Alternatively, the location of stacking lugs across container shells may be aligned or constant without shifting. Different stacking lugs may be formed in a single container shell. The stacking lugs formed in a single container shell may be different in shapes, dimensions or locations. For instance, the shapes and dimensions of the stacking lugs located at the perimeter and the bottom of the container shell may be different.

In some embodiments, different stacking lugs may be used for stacking the container shells at different manufacturing stages. The stacking lugs for stacking container shells after a pulp-molding process may or may not be the same stacking lugs for stacking container shells after a cutting process. For instance, the stacking lugs 1901, 1903 formed along the perimeter as illustrated in FIG. 19 may be used for stacking the pulp-molded container shells and these stacking lugs may be trimmed off during the cutting process. The stacking lugs 2001, 2003 as shown in FIG. 20 may be used for stacking the container shells after the cutting process. Alternatively, stacking lugs formed in a single container shell may be the same. The stacking lug 2001, 2003 can be located anywhere at the bottom of the container shell, such as centered or off-centered. Any number of stacking lugs may be included on the bottom of the container shell. For instance, at least one, two, three, four, five, six, seven, eight, nine, ten, or more stacking lugs may be used for maintaining a spacing and alignment of the stacked container shells.

With respect to FIG. 20, stacking lugs 2001, 2003 may be formed at the bottom of the container shell. These stacking lugs may be formed during pulp-molding process and remained after the cutting process. The shapes and dimensions of the stacking lugs may or may not be the same across container shells to be stacked together. In some instances, the stacking features 2001, 2003 may have a mirror shape in adjacent container shells stacked together in order to control the spacing 2005 between the adjacent container shells. The mirror shape may allow the stacking lugs in adjacent container shells protrude from the bottom surface to different heights at the corresponding location. For example, as indicated by the arrows 2007, 2009, at the same location with respect to the two container shells, the stacking lug 2001 has a higher surface than the stacking lug 2003. With the different protrusion heights, the distance that a container shell nested into the other container shell is controlled as the lower surface of the stacking lug in one container shell contacts and comes to a stop against the high surface of the other container shell. The illustrated example shows two different stacking lugs in a mirrored configuration, however it should be noted any number of different configurations and/or arrangement of stacking lugs can be employed.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A multi-parts container, comprising:

a molded hollow body forming an interior hollow region, said hollow body comprising:

a first molded shell part comprising a plurality of inter-connecting tabs and slits on a first edge as an extending portion of the first molded shell part, the inter-connecting tabs including a leading edge having a curvilinear shape; and a second molded shell part comprising a plurality of inter-connecting features on a second edge as an extending portion of the second molded shell part, wherein the second edge is connected with the first edge when the first molded shell part and the second molded shell part are connected to form the hollow body;

wherein when the plurality of inter-connecting tabs and slits on the first edge are engaged with the plurality of inter-connecting features on the second edge, the engaged inter-connecting tabs are disposed in the interior hollow region of the hollow body;

wherein the first molded shell part and the second molded shell part are each shaped to form a side wall portion, and a neck portion of the container, wherein the outer surface of the container has a shoulder area where the profile curvature of the container transitions inward from the side wall portion to the neck portion, wherein the pitch or spacing of the inter-connecting tabs and slits and the inter-connecting features is less in the area of the shoulder area as compared to an area away from the shoulder area where the curvature is small relative to the curvature in the shoulder area;

wherein at least one of the first edge and the second edge has a curved profile extending from a first end to a second end of the container.

2. The multi-parts container of claim 1, wherein the first edge or the second edge comprises a curved segment.

3. The multi-parts container of claim 1, wherein one or more of the plurality of inter-connecting tabs and slits are formed in a shoulder area of the multi-parts container.

4. The multi-parts container of claim 1, wherein the plurality of inter-connecting tabs and slits have varied shapes or sizes along the first edge.

5. The multi-parts container of claim 1, wherein the plurality of inter-connecting tabs and slits have varied spacing along the first edge.

6. The multi-parts container of claim 1, wherein the inter-connecting features comprises a plurality of tabs and slits that have the same size and shape as the inter-connecting tabs and slits on the first edge.

7. The multi-parts container of claim 1, wherein the inter-connecting features comprises a plurality of slots.

8. The multi-parts container of claim 7, wherein the plurality of slots have a D shape.

9. The multi-parts container of claim 1, wherein the engaged inter-connecting tabs are aligned to an inner surface of the hollow body.

10. The multi-parts container of claim 9, wherein the inner surface is a curved surface.

11. The multi-parts container of claim 1, wherein the first molded shell part and the second molded shell part are formed from a recycled or biodegradable pulp material.

12. The multi-parts container of claim 11, wherein the pulp material is selected from the group of wood pulp and paper pulp.

13. The multi-parts container of claim 1, wherein the molded hollow body is 100% recyclable.

14. The multi-parts container of claim 1, wherein the first molded shell part and the second molded shell part are first molded then cut to form the plurality of inter-connecting tabs and slits, or the inter-connecting features.

15. The multi-parts container of claim 1, further comprising a fitment and a neck to support the fitment.

16. The multi-parts container of claim 15, wherein the fitment comprises one or more interlock features configured to mate one or more complementary features at the neck.

17. The multi-parts container of claim 15, wherein a liner is connected to the multi-parts container by the fitment.

18. A container comprising:

a single pulp-molded open hollow shell having two or more sides to be joined together, wherein at least a first side of the two or more sides comprises a plurality of inter-connecting tabs and slits as an extending portion of the first side of the single pulp-molded open hollow shell, and a second side to be connected with the first side comprises a plurality of inter-connecting features as an extending portion of the second side of the single pulp-molded open hollow shell, and when the first side and the second side are jointed together, the plurality of inter-connecting tabs are disposed in an interior hollow region of the hollow shell, and each of the inter-connecting tabs including a leading edge having a curvilinear shape, wherein the first side and the second side are each shaped to form a side wall portion, and a neck portion of the container, wherein the outer surface of the container has a shoulder area where the profile curvature of the container transitions inward from the side wall portion to the neck portion, wherein the pitch or spacing of the inter-connecting tabs and slits and the inter-connecting features is less in the area of the shoulder area as compared to an area away from the shoulder area where the curvature is small relative to the curvature in the shoulder area; and wherein the plurality of inter-connecting tabs are arranged adjacent a first edge of the first side, and the plurality of inter-connecting features are arranged adjacent to a second edge of the second side, and at least one of the first edge and the second edge has a curved profile extending from a first end to a second end of the container.

19. The container of claim 18, wherein the first side or the second side comprises a curved profile.

20. The container of claim 18, wherein the inter-connecting features comprises a plurality of D shaped slots or a plurality of inter-connecting tabs and slits.

* * * * *